US010717295B2

(12) United States Patent
Kumagai et al.

(10) Patent No.: US 10,717,295 B2
(45) Date of Patent: Jul. 21, 2020

(54) LIQUID EJECTING APPARATUS, LIQUID FILLING METHOD, AND AIR BUBBLE DISCHARGING METHOD

(71) Applicant: SEIKO EPSON CORPORATION, Tokyo (JP)

(72) Inventors: Masaru Kumagai, Shiojiri (JP); Yukihiro Hanaoka, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/405,116

(22) Filed: May 7, 2019

(65) Prior Publication Data

US 2019/0344580 A1 Nov. 14, 2019

(30) Foreign Application Priority Data

May 8, 2018 (JP) ..... 2018-089939

(51) Int. Cl.
*B41J 2/175* (2006.01)
*B41J 2/18* (2006.01)
*B41J 2/19* (2006.01)

(52) U.S. Cl.
CPC ..... *B41J 2/19* (2013.01); *B41J 2/17506* (2013.01); *B41J 2/17523* (2013.01); *B41J 2/17556* (2013.01); *B41J 2/17596* (2013.01); *B41J 2/18* (2013.01)

(58) Field of Classification Search
CPC .... B41J 2/175; B41J 2/17506; B41J 2/17523; B41J 2/17556; B41J 2/17596; B41J 2/18; B41J 2/19
See application file for complete search history.

(56) References Cited

U.S. PATENT DOCUMENTS 8,272,719 B2 * 9/2012 Inoue ..... B41J 2/515 347/85
8,974,046 B2 * 3/2015 Ooishi ..... B41J 2/175 347/7
9,073,336 B1 * 7/2015 Matsumoto ..... B41J 2/18
9,751,317 B2 9/2017 Nakamura et al.
(Continued)

FOREIGN PATENT DOCUMENTS

JP 2011-110851 A 6/2011
JP 2011-110853 A 6/2011
(Continued)

*Primary Examiner* — Anh T Vo
(74) *Attorney, Agent, or Firm* — Workman Nydegger

(57) ABSTRACT

A liquid ejecting apparatus includes: a liquid ejecting head including a liquid chamber which communicates with a nozzle; a supply flow path having a first end connected to a liquid supply source and a second end connected to the liquid chamber; a first circulation flow path having a first end connected to the liquid chamber and a second end connected to a first connecting section in the supply flow path; a supply pump provided in the supply flow path; a first pressure regulating valve provided between the first connecting section and the liquid ejecting head in the supply flow path; a second pressure regulating valve provided in the first circulation flow path; a circulation pump provided in the first circulation flow path and configured to circulate the liquid in a downstream direction; and an opening mechanism configured to forcibly open the first pressure regulating valve.

13 Claims, 12 Drawing Sheets

(56) References Cited

U.S. PATENT DOCUMENTS

| | | | | |
|---|---|---|---|---|
| 2009/0244226 | A1 | 10/2009 | Hoshino | |
| 2013/0010037 | A1 | 1/2013 | Yokoyama et al. | |
| 2013/0021416 | A1 | 1/2013 | Yokoyama et al. | |
| 2013/0100205 | A1 | 4/2013 | Sunouchi et al. | |
| 2013/0169710 | A1 | 7/2013 | Keefe et al. | |
| 2014/0300672 | A1* | 10/2014 | Tsukamoto | B41J 2/18 347/89 |
| 2017/0050444 | A1* | 2/2017 | Urakami | B41J 2/19 |
| 2017/0151805 | A1* | 6/2017 | Sato | B41J 2/16526 |
| 2017/0197432 | A1 | 7/2017 | Yamada et al. | |
| 2017/0239956 | A1 | 8/2017 | Karita et al. | |

FOREIGN PATENT DOCUMENTS

| | | | |
|---|---|---|---|
| JP | 2013-539724 | A | 10/2013 |
| JP | 2017-124620 | A | 7/2017 |

* cited by examiner

LIQUID EJECTING APPARATUS, LIQUID FILLING METHOD, AND AIR BUBBLE DISCHARGING METHOD

The present application is based on, and claims priority from JP Application Serial Number 2018-089939, filed May 8, 2018, the disclosure of which is hereby incorporated by reference herein in its entirety.

BACKGROUND

1. Technical Field

The present disclosure relates to liquid ejecting apparatuses such as ink jet printers, liquid filling methods and air bubble discharging methods in the liquid ejecting apparatuses.

2. Related Art

As an example of a liquid ejecting apparatus, JP-A-2017-124620 discloses a liquid ejection apparatus provided with a circulation path in which liquid circulates between a liquid containing chamber that contains liquid and a liquid ejection head for ejecting liquid. The liquid ejection apparatus includes a pressure adjustment mechanism that adjusts pressure in the circulation path.

In such a liquid ejection apparatus, the liquid ejection head and the circulation path, when empty, are filled with liquid by supplying liquid from the liquid containing chamber toward the liquid ejection head and the circulation path by means of pressurization or depressurization. Here, the pressure of liquid supplied from the liquid containing chamber is adjusted by the pressure adjustment mechanism. Accordingly, liquid is less likely to be distributed to the liquid ejection head and the circulation path. Therefore, it is difficult to ensure the liquid ejection head and the circulation path to be filled with liquid.

SUMMARY

The disclosure is directed to provide a liquid ejecting apparatus in which liquid can be easily filled, a liquid filling method and an air bubble discharging method for the liquid ejecting apparatus.

According to an aspect of the disclosure, a liquid ejecting apparatus includes: a liquid ejecting head including a liquid chamber which communicates with a nozzle through which liquid is ejected onto a medium; a supply flow path having a first end connected to a liquid supply source and a second end connected to the liquid chamber; a first circulation flow path having a first end located upstream and a second end located downstream, the first end being connected to the liquid chamber and the second end being connected to a first connecting section which is provided in a middle of the supply flow path; a supply pump provided upstream relative to the first connecting section in the supply flow path, the supply pump being configured to supply the liquid from the liquid supply source in a downstream direction; a first pressure regulating valve provided between the first connecting section and the liquid ejecting head in the supply flow path, the first pressure regulating valve being configured to open when a downstream pressure becomes lower than a predetermined pressure; a second pressure regulating valve provided in the first circulation flow path, the second pressure regulating valve being configured to close when an upstream pressure becomes lower than a predetermined pressure; a circulation pump provided downstream relative to the second pressure regulating valve in the first circulation flow path, the circulation pump being configured to circulate the liquid in a downstream direction; and an opening mechanism configured to forcibly open the first pressure regulating valve.

DESCRIPTION OF EXEMPLARY EMBODIMENTS

With reference to the drawings, an embodiment of a liquid ejecting apparatus will be described. A liquid ejecting apparatus is, for example, an ink jet printer that performs printing of images such as characters and pictures by ejecting ink, which is an example of liquid, onto a medium such as a paper sheet.

First Embodiment

Figure 1:
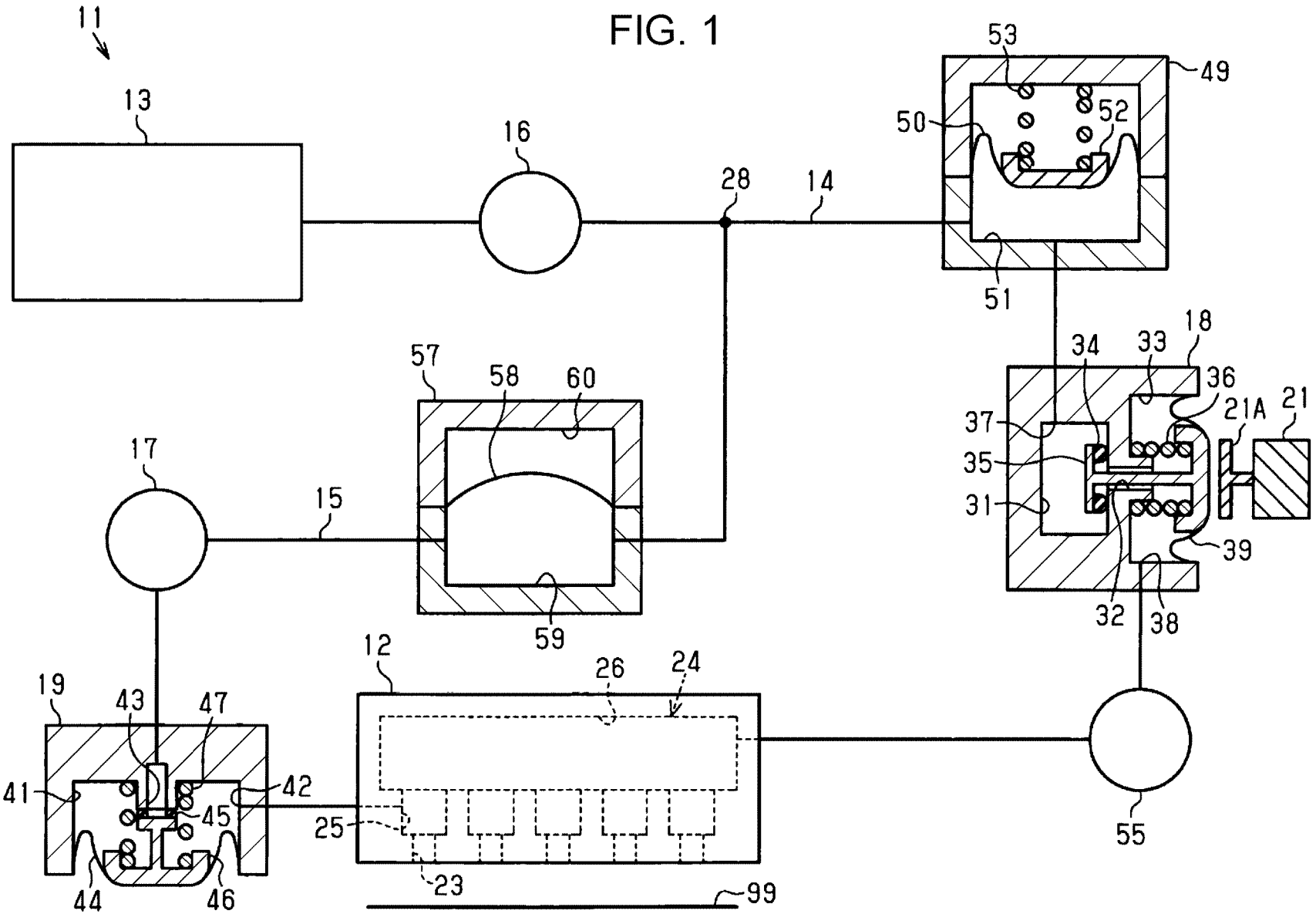
FIG. 1 is an overall configuration diagram of a first embodiment of a liquid ejecting apparatus.

As shown in FIG. 1, a liquid ejecting apparatus 11 includes a liquid ejecting head 12 that ejects liquid, a supply flow path 14 for supplying liquid from a liquid supply source 13 to the liquid ejecting head 12, and a first circulation flow path 15 for circulating liquid. The liquid ejecting apparatus 11 includes a supply pump 16 that supplies liquid via the supply flow path 14, and a circulation pump 17 that circulates liquid via the first circulation flow path 15. The liquid ejecting apparatus 11 includes a first pressure regulating valve 18 that adjusts pressure in the supply flow path 14, and a second pressure regulating valve 19 that adjusts pressure in the first circulation flow path 15. The liquid ejecting apparatus 11 includes an opening mechanism 21 configured to forcibly open the first pressure regulating valve 18.

The liquid ejecting head 12 has one or more nozzles 23. The liquid ejecting head 12 has a liquid chamber 24 which communicates with the nozzles 23. The liquid chamber 24 is configured to store liquid. The liquid ejecting head 12 performs printing on a medium 99 by ejecting liquid stored in the liquid chamber 24 onto a medium 99 via the nozzles 23.

The liquid chamber 24 has a pressure chamber 25 which communicates with the nozzles 23, and a common liquid chamber 26 which communicates with the pressure chamber 25. The pressure chamber 25 is provided for each nozzle 23. Accordingly, the number of the pressure chambers 25 corresponds to the number of the nozzles 23. The common liquid chamber 26 communicates with the respective pressure chambers 25. Liquid stored in the common liquid chamber 26 is supplied to the respective pressure chambers 25. The pressure chambers 25 are provided with, for example, a piezoelectric element. As the piezoelectric element applies pressure to the pressure chamber 25, liquid is ejected through the nozzles 23.

The liquid supply source 13 is, for example, an ink cartridge that stores ink. In this case, the liquid supply source 13 is preferably detachably attached to the liquid ejecting apparatus 11. The liquid supply source 13 may be a detachable ink pack or an ink tank that can be refilled with liquid.

A first end of the supply flow path 14 is connected to the liquid supply source 13. A second end of the supply flow path 14 is connected to the liquid chamber 24. In the first embodiment, the second end of the supply flow path 14 is connected to the common liquid chamber 26 of the liquid chamber 24. In the supply flow path 14, an end connected to the liquid supply source 13 is located upstream, and an end connected to the liquid chamber 24 is located downstream.

A first end of the first circulation flow path 15 is connected to the liquid chamber 24. A second end of the first circulation flow path 15 is connected to a first connecting section 28 which is provided in the middle of the supply flow path 14. In the first embodiment, the first circulation flow path 15 is connected to the pressure chamber 25 of the liquid chamber 24. When a plurality of pressure chambers 25 are provided, the first circulation flow path 15 is connected to the respective pressure chambers 25. In the first circulation flow path 15, an end connected to the liquid chamber 24 is located upstream, and an end connected to the first connecting section 28 is located downstream. The first connecting section 28 is a connection point between the supply flow path 14 and the first circulation flow path 15.

Liquid flowing in the first circulation flow path 15 is fed back to the supply flow path 14 via the first connecting section 28. Accordingly, liquid flows in the liquid chamber 24 of the liquid ejecting head 12, the supply flow path 14, and the first circulation flow path 15 to circulate in the liquid ejecting apparatus 11. Due to the circulation of liquid, liquid can be prevented from thickening. Further, due to the circulation of liquid, foreign substances such as air bubble contained in the liquid flowing in the nozzles 23, the liquid chamber 24, the supply flow path 14, and the first circulation flow path 15 can be discharged.

The supply pump 16 is provided in the supply flow path 14. The supply pump 16 is provided upstream relative to the first connecting section 28 in the supply flow path 14. The supply pump 16 supplies liquid in the downstream direction from the liquid supply source 13. The supply pump 16 may be a diaphragm pump, tube pump, syringe pump, or the like.

The first pressure regulating valve 18 is provided in the supply flow path 14. The first pressure regulating valve 18 is provided between the first connecting section 28 and the liquid ejecting head 12 in the supply flow path 14. The first pressure regulating valve 18 opens and closes in response to the pressure in the supply flow path 14. The first pressure regulating valve 18 opens when the downstream pressure in the supply flow path 14 becomes lower than a predetermined pressure.

As the liquid ejecting head 12 ejects liquid from the nozzles 23, the pressure in the liquid chamber 24 decreases. When the pressure in the liquid chamber 24 becomes lower than a predetermined pressure, the first pressure regulating valve 18 opens. When the first pressure regulating valve 18 opens, liquid is supplied to the liquid chamber 24. As liquid is supplied to the liquid chamber 24, the pressure in the liquid chamber 24 increases. When the pressure in the liquid chamber 24 becomes a predetermined pressure or higher, the first pressure regulating valve 18 closes. Thus, the first pressure regulating valve 18 opens to thereby maintain the pressure in the liquid chamber 24.

By maintaining the pressure in the liquid chamber 24 in the liquid ejecting head 12, liquid can be accurately ejected from the nozzles 23. In particular, maintaining the pressure in the liquid chamber 24 at negative pressure facilitates formation of a meniscus at a gas-liquid interface in the nozzle 23. Accordingly, liquid can be further accurately ejected from the nozzles 23. By maintaining the pressure in the liquid chamber 24 at negative pressure, leakage of liquid from the nozzles 23 can be reduced. Therefore, the first pressure regulating valve 18 is preferably configured to maintain the pressure in the liquid chamber 24 at negative pressure.

In the first embodiment, a working pressure of the first pressure regulating valve 18 is approximately −2 kPa. That is, when the pressure in the liquid ejecting head 12 becomes lower than −2 kPa, the first pressure regulating valve 18 opens. When the pressure in the liquid ejecting head 12 becomes −2 kPa or higher, the first pressure regulating valve 18 closes. Thus, the first pressure regulating valve 18 works to keep the pressure in the liquid ejecting head 12 at −2 kPa.

The opening mechanism 21 forcibly opens the first pressure regulating valve 18 regardless of the pressure in the liquid chamber 24 in the liquid ejecting head 12. When the supply pump 16 is actuated while the first pressure regulating valve 18 is opened by the opening mechanism 21, liquid is supplied to the liquid chamber 24 regardless of the pressure in the liquid chamber 24.

The second pressure regulating valve 19 is provided in the first circulation flow path 15. The second pressure regulating valve 19 opens and closes in response to the pressure in the first circulation flow path 15. The second pressure regulating valve 19 closes when the upstream pressure in the first circulation flow path 15 becomes lower than a predetermined pressure.

The circulation pump 17 is provided in the first circulation flow path 15. The circulation pump 17 is provided downstream relative to the second pressure regulating valve 19 in the first circulation flow path 15. The circulation pump 17 circulates liquid in the first circulation flow path 15 in the downstream direction. The circulation pump 17 may be a diaphragm pump, tube pump, syringe pump, or the like.

In the first circulation flow path 15, as the circulation pump 17 circulates liquid, the pressure upstream from the second pressure regulating valve 19 decreases. When the pressure upstream from the second pressure regulating valve 19 becomes lower than a predetermined pressure, the second pressure regulating valve 19 closes. When the second pressure regulating valve 19 closes, a flow of liquid from the liquid chamber 24 to the first circulation flow path 15 stops. Since the second pressure regulating valve 19 closes, the pressure upstream from the second pressure regulating valve 19 becomes likely to increase. When the pressure upstream from the second pressure regulating valve 19 becomes a predetermined pressure or higher due to the liquid supplied, the second pressure regulating valve 19 opens. Thus, the second pressure regulating valve 19 closes so as to constantly keep the pressure upstream from the second pressure regulating valve 19.

A working pressure of the second pressure regulating valve 19 is set to be lower than the working pressure of the first pressure regulating valve 18 so that liquid is fed from the supply flow path 14 to the first circulation flow path 15 via the liquid chamber 24 of the liquid ejecting head 12. In the first embodiment, the working pressure of the second pressure regulating valve 19 is approximately −6 kPa. That is, when the pressure upstream from the second pressure regulating valve 19 becomes lower than −6 kPa, the second pressure regulating valve 19 closes. When the pressure upstream from the second pressure regulating valve 19 becomes −6 kPa or higher, the second pressure regulating valve 19 opens. Thus, the second pressure regulating valve 19 works to keep the upstream pressure at −6 kPa. Since the pressure upstream from the second pressure regulating valve 19 is maintained at −6 kPa, the pressure in the liquid ejecting head 12, which is located further upstream, is maintained in the range of approximately −300 to −500 Pa due to pressure loss and the like.

Next, the first pressure regulating valve 18 will be described. The first pressure regulating valve 18 includes a first supplying chamber 31 provided in the middle of the supply flow path 14, and a second supplying chamber 33 which communicates with the first supplying chamber 31 via an aperture 32. The first pressure regulating valve 18 has a valve body 34 configured to open and close the aperture 32, and a pressure receiving member 35 whose proximal end portion is housed in the first supplying chamber 31 and whose distal end portion is housed in the second supplying chamber 33. The first pressure regulating valve 18 has a pressing member 36 that presses the pressure receiving member 35.

The first supplying chamber 31 is provided with an inlet port 37 through which liquid flows in. The second supplying chamber 33 is provided with an outlet port 38 through which liquid flows out. The second supplying chamber 33 has a wall which is partially formed of a flexible film 39 that can be flexibly displaced. The valve body 34 is made of, for example, an elastic material such as rubber, and is mounted on a proximal end portion of the pressure receiving member 35 located in the first supplying chamber 31.

The pressing member 36 is formed of a spring, for example, and is housed in the second supplying chamber 33. The pressing member 36 presses a distal end portion of the pressure receiving member 35 against the flexible film 39. As the distal end portion of the pressure receiving member 35 is pressed by the pressing member 36, the valve body 34 mounted on the proximal end portion of the pressure receiving member 35 is pressed against the wall of the first supplying chamber 31 in which aperture 32 is open. Accordingly, the valve body 34 closes the aperture 32. That is, the pressing member 36 presses the pressure receiving member 35 against the flexible film 39 so that the valve body 34 closes the aperture 32.

The pressure receiving member 35 is displaced when pressed by the flexible film 39 which is displaced in the direction that decreases the volume of the second supplying chamber 33. The flexible film 39 is flexibly displaced in the direction that decreases the volume of the second supplying chamber 33 when the pressure in the second supplying chamber 33 decreases due to discharge of liquid from the nozzles 23. When the pressure applied to an inner surface of the flexible film 39 which faces the second supplying chamber 33 becomes lower than the pressure applied to the outer surface of the flexible film 39 which faces away from the second supplying chamber 33 and when a difference between the pressure applied to the inner surface and the pressure applied to an outer surface becomes a predetermine amount or more, the pressure receiving member 35 is displaced. Accordingly, the valve body 34 opens the aperture 32.

As liquid flows from the first supplying chamber 31 into the second supplying chamber 33 in response to opening of the aperture 32, the pressure of the second supplying chamber 33 increases. As the pressure in the second supplying chamber 33 increases, the pressure receiving member 35 is displaced to cause the valve body 34 to close the aperture 32. Thus, the valve body 34 autonomously opens and closes the aperture 32 in response to a pressure difference between the pressure outside the second supplying chamber 33 and the pressure inside the second supplying chamber 33.

The first pressure regulating valve 18 is preferably configured such that the outlet port 38 is located at an uppermost position in the second supplying chamber 33. This facilitates discharge of air bubble which has flowed into the first pressure regulating valve 18.

The opening mechanism 21 is configured to open the aperture 32 of the first pressure regulating valve 18. The opening mechanism 21 has a displacement member 21A that displaces the flexible film 39 in the direction that decreases the volume of the second supplying chamber 33, for example. The opening mechanism 21 opens the aperture 32 of the first pressure regulating valve 18 by the displacement member 21A pressing the flexible film 39. The opening mechanism 21 is formed of, for example, a cam mechanism.

Next, the second pressure regulating valve 19 will be described. The second pressure regulating valve 19 has a circulation chamber 41 disposed in the middle of the first circulation flow path 15. The circulation chamber 41 is provided with an inlet port 42 through which liquid flows in and an outlet port 43 through which liquid flows out. The circulation chamber 41 has a wall which is partially formed of a flexible film 44 that can be flexibly displaced. The second pressure regulating valve 19 includes a valve body 45 configured to open and close the outlet port 43, a pressure receiving member 46 on which the valve body 45 is mounted, and a pressing member 47 that presses the pressure receiving member 46.

The valve body 45 is made of, for example, an elastic material such as rubber. The pressure receiving member 46 is housed in the circulation chamber 41. The pressing member 47 is formed of a spring, for example, and is housed in the circulation chamber 41. The pressing member 47 presses the pressure receiving member 46 against the flexible film 39. The pressing member 47 presses the pressure receiving member 46 so that the valve body 45 is separated from the wall of the circulation chamber 41 in which the outlet port 43 is open. Accordingly, the valve body 45 opens the outlet port 43. That is, the pressing member 47 presses the pressure receiving member 46 against the flexible film 44 so that the valve body 45 opens the outlet port 43.

The pressure receiving member 46 is displaced when pressed by the flexible film 44 which is displaced in the direction that decreases the volume of the circulation chamber 41. The flexible film 44 is flexibly displaced in the direction that decreases the volume of the circulation chamber 41 when the pressure in the circulation chamber 41 decreases due to circulation of liquid in the first circulation flow path 15 by the circulation pump 17. When the pressure applied to an inner surface of the flexible film 44 which faces the circulation chamber 41 becomes lower than the pressure applied to the outer surface of the flexible film 44 which faces away from the circulation chamber 41 and when a difference between the pressure applied to the inner surface and the pressure applied to an outer surface becomes a predetermine amount or more, the pressure receiving member 46 is displaced. Accordingly, the valve body 45 closes the outlet port 43.

As liquid flows into the circulation chamber 41 while the outlet port 43 is closed, the pressure of the circulation chamber 41 increases. As the pressure in the circulation chamber 41 increases, the pressure receiving member 46 is displaced to cause the valve body 45 to open the outlet port 43. Thus, the valve body 45 autonomously opens and closes the outlet port 43 in response to a pressure difference between the pressure outside the circulation chamber 41 and the pressure inside the circulation chamber 41. In the present embodiment, the pressure upstream from the second pressure regulating valve 19 refers to the pressure in the circulation chamber 41.

The second pressure regulating valve 19 is preferably configured such that the outlet port 43 is located at an uppermost position in the circulation chamber 41. This facilitates discharge of air bubble which has flowed into the second pressure regulating valve 19. The liquid ejecting apparatus 11 may also include a buffer 49 configured to store liquid at a position downstream relative to the supply pump 16 in the supply flow path 14. The buffer 49 of the first embodiment is located between the first connecting section 28 and the first pressure regulating valve 18 in the supply flow path 14. The buffer 49 includes a buffer chamber 51 having a wall which is partially formed of a flexible film 50 that can be flexibly displaced. The buffer 49 includes a pressure receiving member 52 that is in contact with the flexible film 50 from outside the buffer chamber 51, and a pressing member 53 that presses the pressure receiving member 52 against the flexible film 50 from outside the buffer chamber 51. The pressing member 53 is formed of a spring, for example. The pressing member 53 presses the flexible film 50 via the pressure receiving member 52 in the direction that decreases the volume of the buffer chamber 51.

As liquid is supplied to the buffer chamber 51 by the supply pump 16, the flexible film 50 is displaced in the direction that increases the volume of the buffer chamber 51. Accordingly, liquid is temporarily stored in the buffer chamber 51. As liquid is stored in the buffer chamber 51, air bubbles rise up in the stored liquid and accumulate in an upper space in the buffer chamber 51. Thus, the buffer 49 captures air bubbles in liquid.

As the flexible film 50 is displaced in the direction that increases the volume of the buffer chamber 51, the buffer chamber 51 is pressurized by the pressing member 53. Accordingly, liquid stored in the buffer chamber 51 is supplied downstream. That is, the buffer 49 can mitigate variation in pressure of liquid in the supply flow path 14 by displacement of the flexible film 50. By providing the buffer 49, pulsation of liquid in the supply flow path 14 can be reduced and the pressure in the supply flow path 14 can be readily stabilized.

The liquid ejecting apparatus 11 may also include a pressurizing pump 55 at a position between the first pressure regulating valve 18 and the liquid ejecting head 12 in the supply flow path 14. The pressurizing pump 55 pressurizes liquid downstream therefrom. Accordingly, when the pressurizing pump 55 is actuated, liquid in the liquid chamber 24 of the liquid ejecting head 12 is pressurized. This causes strong ejection of liquid from the nozzles 23. When liquid is strongly ejected from the nozzles 23, it is possible to discharge, for example, thickened liquid in the liquid ejecting head 12 and foreign substances such as air bubble. Discharging liquid from the nozzles 23 by pressurizing liquid in the liquid chamber 24 by using the pressurizing pump 55 is also referred to as pressurized cleaning. The pressurizing pump 55 may be a diaphragm pump, tube pump, syringe pump, or the like.

The liquid ejecting apparatus 11 may not necessarily include the pressurizing pump 55. When the supply pump 16 is actuated while the first pressure regulating valve 18 is opened by the opening mechanism 21, liquid in the liquid chamber 24 of the liquid ejecting head 12 can be pressurized. That is, pressurized cleaning can be performed by using the supply pump 16.

The liquid ejecting apparatus 11 may also include a defoaming portion 57 at a position between the circulation pump 17 and the first connecting section 28 in the first circulation flow path 15 so as to remove air bubbles in liquid. The defoaming portion 57 has a storage chamber 59 and an accommodating chamber 60 separated by a separation film 58. The separation film 58 is a film that allows air to pass through but does not allow liquid to pass through. The storage chamber 59 is provided in the middle of the first circulation flow path 15, and is configured to store liquid.

As liquid in the storage chamber 59 is pressurized by the circulation pump 17, air bubbles contained in liquid in the storage chamber 59 passes through the separation film 58. That is, air bubbles are separated from liquid via the separation film 58. The separated air bubbles are accommodated in the accommodating chamber 60. The accommodating chamber 60 preferably communicates with the outside to discharge air bubbles. The defoaming portion 57 may also serve as the buffer 49.

A circulation flow rate of liquid flowing from the liquid chamber 24 to the first circulation flow path 15 in a non-ejection period during which liquid is not ejected from the nozzles 23 is preferably one-tenth or more of a maximum ejection flow rate of liquid ejected from the nozzles 23 onto the medium 99. The circulation flow rate is the amount of liquid per unit time flowing from the liquid chamber 24 to the first circulation flow path 15. When the second pressure regulating valve 19 closes, the circulation flow rate becomes 0. The ejection flow rate is the amount of liquid per unit time ejected from the nozzles 23. Accordingly, the maximum ejection flow rate refers to a maximum amount of ejection flow rate that the liquid ejecting head 12 can eject. The liquid ejecting head 12 ejects liquid at a maximum ejection flow rate, for example, when performing printing across the entire surface of the medium 99.

The circulation flow rate in printing onto the medium 99 varies depending on the ejection flow rate. The higher the ejection flow rate, the lower the circulation flow rate. When liquid is ejected from all the nozzles 23, that is, when liquid is ejected at a maximum ejection flow rate, circulation flow rate may become 0. In this case, since a flow of liquid is generated in all the nozzles 23, there is a low possibility that liquid in the liquid chamber 24 is thickened even if the circulation flow rate becomes 0.

The circulation flow rate is determined depending on a ratio between the flow path resistance from the first pressure regulating valve 18 to the liquid chamber 24 and the flow path resistance from the liquid chamber 24 to the second pressure regulating valve 19, and a difference between the working pressure of the first pressure regulating valve 18 and the working pressure of the second pressure regulating valve 19. By setting the circulation flow rate in the non-ejection period to be one-tenth or more of the maximum ejection flow rate, a sufficient amount of liquid is ensured to flow from the liquid chamber 24 toward the first circulation flow path 15 during printing in which liquid is ejected from the nozzles 23. Accordingly, thickening of liquid in the liquid ejecting head 12 can be reduced.

Figure 2:
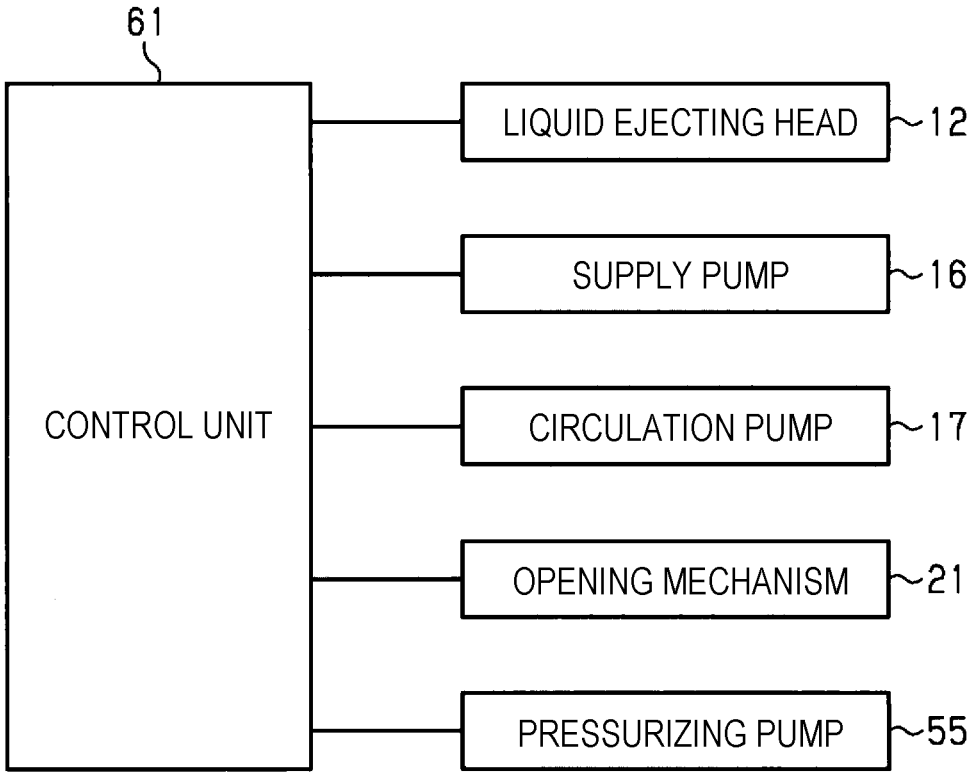
FIG. 2 is a block diagram of an electric configuration of the liquid ejecting apparatus.

An electric configuration of the liquid ejecting apparatus 11 will now be described. As shown in FIG. 2, the liquid ejecting apparatus 11 includes a control unit 61 that integrates and controls the overall apparatus. The control unit 61 is configured with a CPU, memory, and the like. In the first embodiment, the control unit 61 controls the liquid ejecting head 12, the supply pump 16, the circulation pump 17, the opening mechanism 21 and the pressurizing pump 55.

Next, processing operations performed by the liquid ejecting apparatus 11 will now be described. When the liquid ejecting head 12 is empty or liquid in the liquid ejecting head 12 is in short supply, the liquid ejecting apparatus 11 performs a liquid filling operation for filling the liquid ejecting head 12 with liquid.

Figure 3:
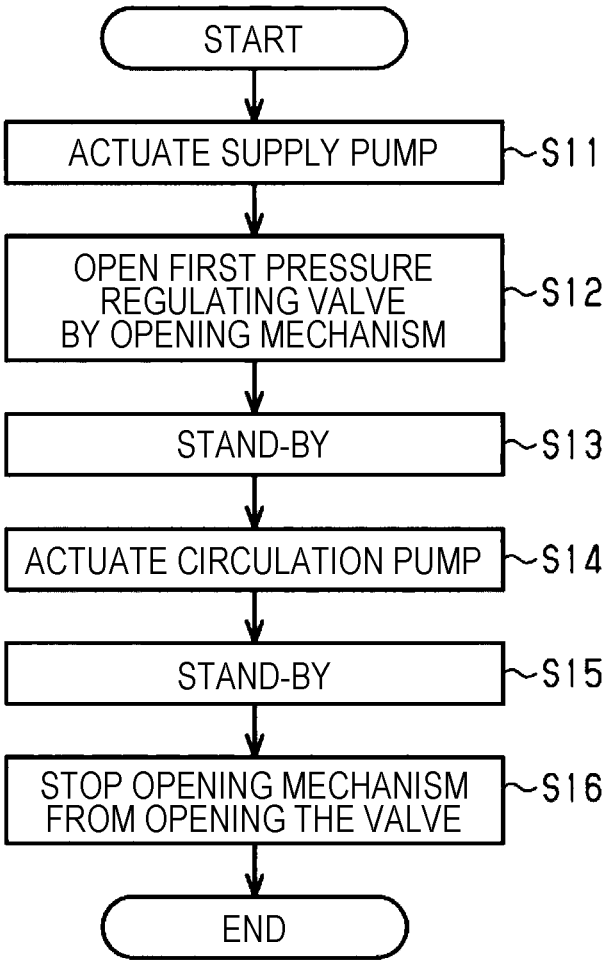
FIG. 3 is a flowchart of a processing routine for a liquid filling operation.

As shown in FIG. 3, in Step S11, the control unit 61 that performs the liquid filling operation actuates the supply pump 16. Upon actuation of the supply pump 16, liquid flows from the liquid supply source 13 toward the supply flow path 14. Here, the first pressure regulating valve 18 is closed since the pressure in the liquid ejecting head 12 is equal to an atmospheric pressure.

In Step S12, the control unit 61 opens the first pressure regulating valve 18 by the opening mechanism 21. When the first pressure regulating valve 18 opens while the supply pump 16 is actuated, liquid is supplied from the liquid supply source 13 to the liquid ejecting head 12.

In Step S13, the control unit 61 stands-by. When the first pressure regulating valve 18 remains opened while the supply pump 16 is actuated, the supply flow path 14 and the liquid ejecting head 12 are filled with liquid. In Step S13, the control unit 61 stands-by until the nozzles 23 are filled with liquid. In Step S13, the control unit 61 stands-by, for example, for a period of time expected to allow the nozzles 23 to be filled with liquid. That is, in Steps S11, S12, and S13, the control unit 61 performs a first filling step for filling liquid into the nozzles 23 by forcibly opening the first pressure regulating valve 18 by using the opening mechanism 21 while the supply pump 16 is actuated.

In Step S14, the control unit 61 actuates the circulation pump 17. In Step S14, the second pressure regulating valve 19 opens since the liquid ejecting head 12 is filled with liquid. When the circulation pump 17 is actuated while the second pressure regulating valve 19 is open, liquid flows from the liquid ejecting head 12 toward the first connecting section 28.

In Step S15, the control unit 61 stands-by. When the circulation pump 17 is continuously actuated, the first circulation flow path 15 is filled with liquid. That is, in Steps S14 and S15, the control unit 61 performs a second filling step for filling liquid into the first circulation flow path 15 by actuating the circulation pump 17 while the supply pump 16 is actuated.

In Step S16, the control unit 61 stops the opening mechanism 21 from opening the valve. When the control unit 61 stops the forcible opening of the first pressure regulating valve 18 by the opening mechanism 21, the liquid filling operation is completed. After completion of the liquid filling operation, the supply pump 16 and the circulation pump 17 remain actuated to thereby circulate liquid. Thus, in the liquid ejecting apparatus 11 of the first embodiment, liquid is filled by the liquid filling method which includes the first filling step and the second filling step. The processing in Step S16 may also be performed between Step S13 and Step S14. That is, forcible opening of the first pressure regulating valve 18 by the opening mechanism 21 may also be stopped between the first filling step and the second filling step.

In filling liquid into the liquid ejecting head 12, the supply flow path 14, and the first circulation flow path 15, which are not filled with liquid, actuation of the supply pump 16 is not sufficient to open the first pressure regulating valve 18 since the liquid chamber 24 of the liquid ejecting head 12 is filled with air. Therefore, by forcibly opening the first pressure regulating valve 18 by using the opening mechanism 21, liquid is supplied from the liquid supply source 13 to the liquid ejecting head 12 via the supply flow path 14. When liquid is supplied to the liquid ejecting head 12, liquid is supplied to the first circulation flow path 15 by actuation of the circulation pump 17. Thus, filling of liquid can be easily performed.

In the state in which liquid is filled, the liquid ejecting apparatus 11 performs an air bubble discharging operation for discharging air bubbles. The liquid ejecting apparatus 11 performs the air bubble discharging operation, for example, after performing the liquid filling operation.

Figure 4:
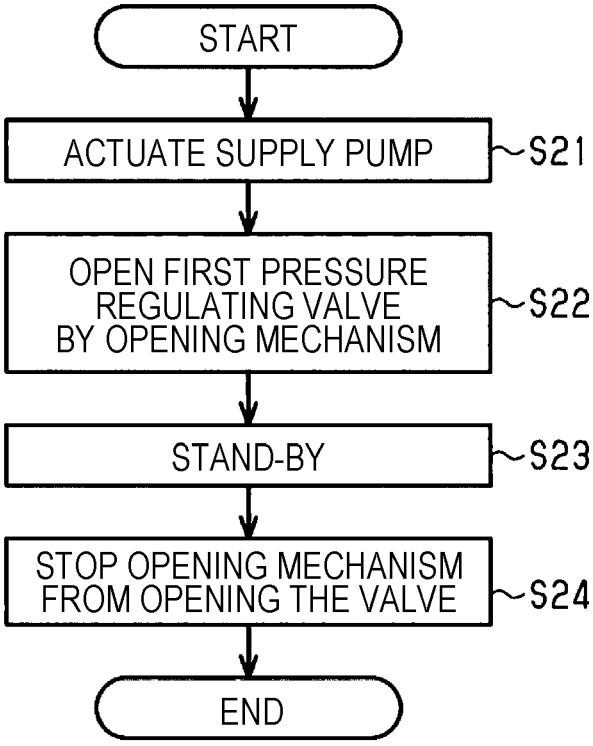
FIG. 4 is a flowchart of a processing routine for an air bubble discharging operation.

As shown in FIG. 4, in Step S21, the control unit 61 that performs the air bubble discharging operation actuates the supply pump 16. If the supply pump 16 has been already actuated in Step S21, the control unit 61 continues actuation of the supply pump 16.

In Step S22, the control unit 61 opens the first pressure regulating valve 18 by the opening mechanism 21. When the first pressure regulating valve 18 is forcibly opened while the supply pump 16 is actuated, liquid flows to the liquid ejecting head 12 regardless of the pressure in the liquid chamber 24. Accordingly, in the case where the first pressure regulating valve 18 is forcibly opened, a supply flow rate of liquid supplied to the liquid ejecting head 12 increases compared with the case where the first pressure regulating valve 18 is not forcibly opened.

In Step S23, the control unit 61 stands-by. When the first pressure regulating valve 18 remains opened while the supply pump 16 is actuated, the liquid ejecting head 12 is filled with liquid via the supply flow path 14. Accordingly, liquid in the liquid chamber 24 is pressurized. As a result, liquid is discharged from the nozzles 23. Here, air bubbles in the supply flow path 14 are discharged together with liquid from the nozzles 23. Accordingly, in Step S23, the control unit 61 stands-by, for example, for a period of time expected to sufficiently discharge air bubbles. In summary, in Steps S21, S22, and S23, the control unit 61 discharges air bubbles contained in the supply flow path 14 by forcibly opening the first pressure regulating valve 18 by using the opening mechanism 21 while the supply pump 16 is actuated.

In Step S24, the control unit 61 stops the opening mechanism 21 from opening the valve. When the control unit 61 stops the forcible opening of the first pressure regulating valve 18 by the opening mechanism 21, the air bubble discharging operation is completed. In the liquid ejecting apparatus 11 of the first embodiment, air bubble is discharged by the air bubble discharging method described above.

Next, effects and advantages of the liquid ejecting apparatus 11 in the first embodiment will be described.

(1) The liquid ejecting apparatus 11 includes the opening mechanism 21 configured to forcibly open the first pressure regulating valve 18. In filling liquid into the liquid ejecting head 12 and the respective flow paths, which are not filled with liquid, in the liquid ejecting apparatus 11, the liquid chamber 24 of the liquid ejecting head 12 is filled with air. Accordingly, actuation of the supply pump 16 is not sufficient to open the first pressure regulating valve 18. According to the first embodiment, by forcibly opening the first pressure regulating valve 18 by using the opening mechanism 21, liquid is supplied from the liquid supply source 13 to the liquid ejecting head 12 via the supply flow path 14. When liquid is supplied to the liquid ejecting head 12, liquid is supplied to the first circulation flow path 15 by actuation of the circulation pump 17. Accordingly, filling of liquid can be easily performed.

(2) The circulation flow rate of liquid flowing from the liquid chamber 24 to the first circulation flow path 15 in the non-ejection period during which liquid is not ejected from the nozzles 23 is one-tenth or more of the maximum ejection flow rate of liquid ejected from the nozzles 23 onto the medium 99. Accordingly, a sufficient amount of liquid can be ensured to flow from the liquid chamber 24 to the first circulation flow path 15 during printing in which liquid is ejected from the nozzles 23. Therefore, thickening of liquid in the liquid ejecting head 12 can be reduced.

(3) According to the liquid filling method which includes the first filling step for filling liquid into the nozzles 23 by forcibly opening the first pressure regulating valve 18 by using the opening mechanism 21 while the supply pump 16 is actuated, and the second filling step for filling liquid into the first circulation flow path 15 by actuating the circulation pump 17 while the supply pump 16 is actuated, filling of liquid can be effectively performed.

(4) According to the air bubble discharging method for discharging air bubbles contained in the supply flow path 14 from the nozzles 23 by forcibly opening the first pressure regulating valve 18 by using the opening mechanism 21 while the supply pump 16 is actuated, air bubbles can be effectively discharged.

Second Embodiment

Next, a second embodiment of the liquid ejecting apparatus 11 will now be described. The liquid ejecting apparatus 11 of the second embodiment has the same configuration as that of the liquid ejecting apparatus 11 of the first embodiment except for the configuration of the buffer 49 and the defoaming portion 57. Therefore, in the second embodiment, differences in configuration will be mainly described.

Figure 5:
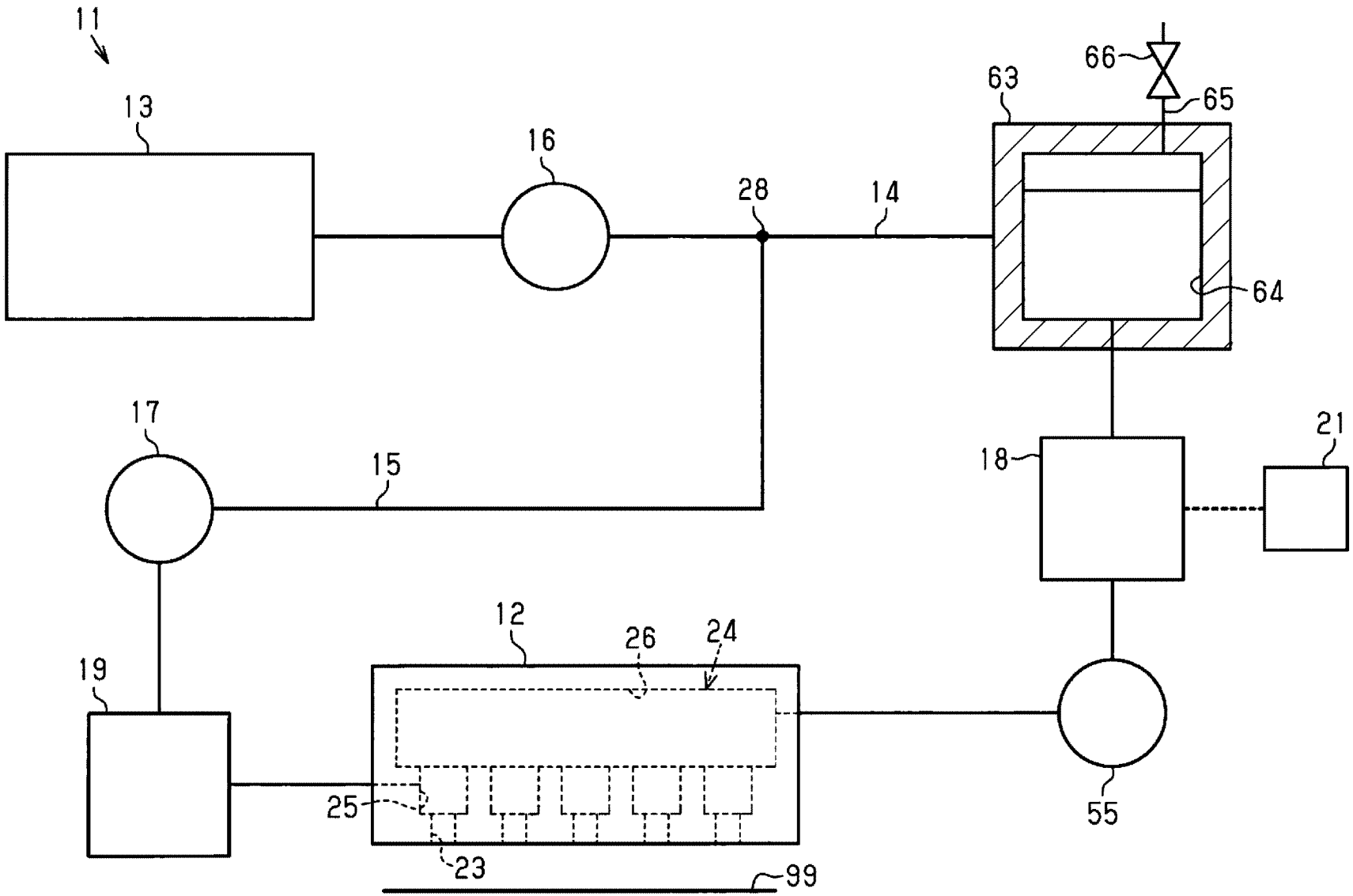
FIG. 5 is an overall configuration diagram of a second embodiment of the liquid ejecting apparatus.

As shown in FIG. 5, the liquid ejecting apparatus 11 of the second embodiment includes a buffer 63 configured to store liquid. The buffer 63 is located between the first connecting section 28 and the first pressure regulating valve 18 in the supply flow path 14. The buffer 63 includes a buffer chamber 64 for storing liquid. The buffer chamber 64 is located in the middle of the supply flow path 14. As liquid is stored in the buffer chamber 64, air bubbles rise up in the stored liquid and accumulate in an upper space in the buffer chamber 64. Thus, the buffer 63 captures air bubbles in liquid.

The liquid ejecting apparatus 11 includes an air bubble discharge flow path 65 for discharging air bubbles. The air bubble discharge flow path 65 is located in the middle of the supply flow path 14. The air bubble discharging flow path 65 is connected to the supply flow path 14 at a position downstream relative to the first connecting section 28. In the second embodiment, the air bubble discharge flow path 65 is provided in the buffer 63. The buffer chamber 64 in the buffer 63 communicates with the outside via the air bubble discharge flow path 65. By providing the air bubble discharge flow path 65 in the buffer 63, air bubbles captured in the buffer 63 can be discharged via the air bubble discharge flow path 65. The air bubble discharge flow path 65 is preferably provided to communicate with an upper space in the buffer chamber 64. This reduces possibility of liquid flowing out from the air bubble discharge flow path 65.

The liquid ejecting apparatus 11 includes an open-close valve 66 for opening and closing the air bubble discharge flow path 65. The open-close valve 66 opens the air bubble discharge flow path 65 when discharging air bubbles from the buffer chamber 64. Accordingly, by providing the air bubble discharge flow path 65 and the open-close valve 66, the buffer 63 can remove air bubbles from liquid. That is, in the second embodiment, the buffer 63 also serves as the defoaming portion 57.

Figure 6:
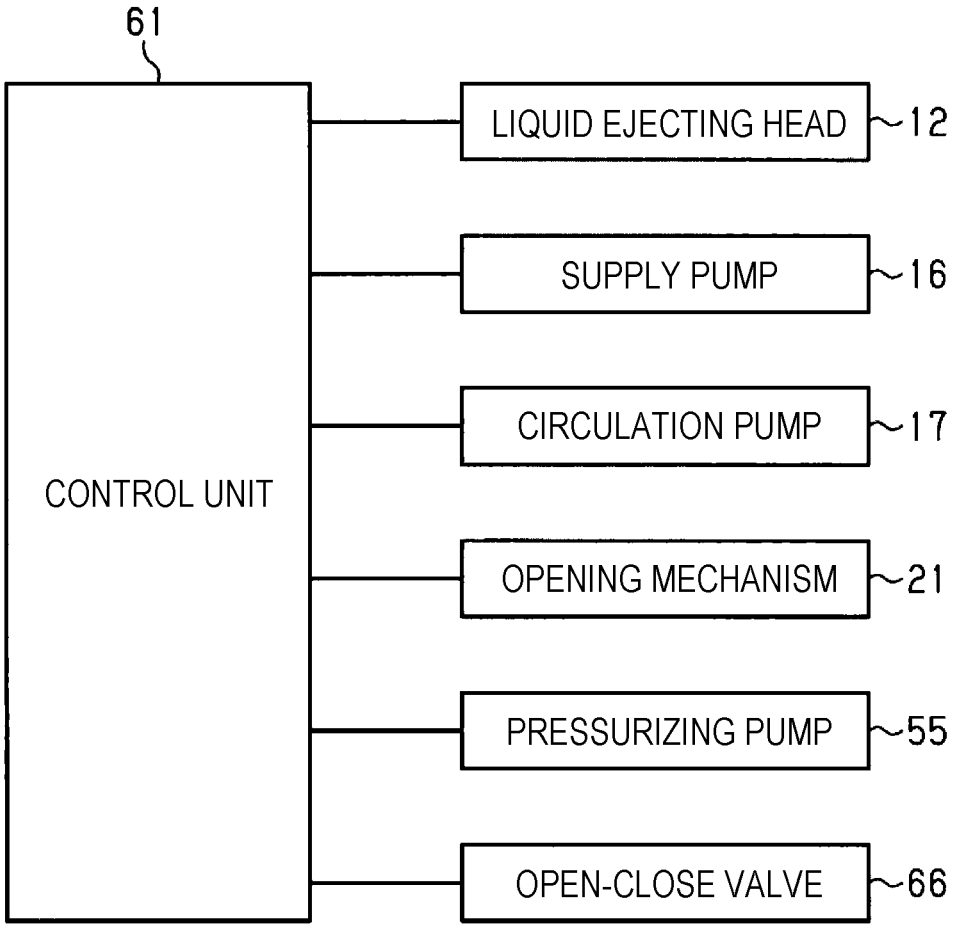
FIG. 6 is a block diagram of an electric configuration of the liquid ejecting apparatus.

An electric configuration of the liquid ejecting apparatus 11 of the second embodiment will now be described. As shown in FIG. 6, the liquid ejecting apparatus 11 includes a control unit 61 that integrates and controls the overall apparatus. The control unit 61 is configured with a CPU, memory, and the like. In the second embodiment, the control unit 61 controls the liquid ejecting head 12, the supply pump 16, the circulation pump 17, the opening mechanism 21, the pressurizing pump 55, and the open-close valve 66.

Next, an air bubble discharging operation performed by the liquid ejecting apparatus 11 of the second embodiment will now be described. Further, the liquid filling operation performed by the liquid ejecting apparatus 11 of the second embodiment is the same as that of the first embodiment.

Figure 7:
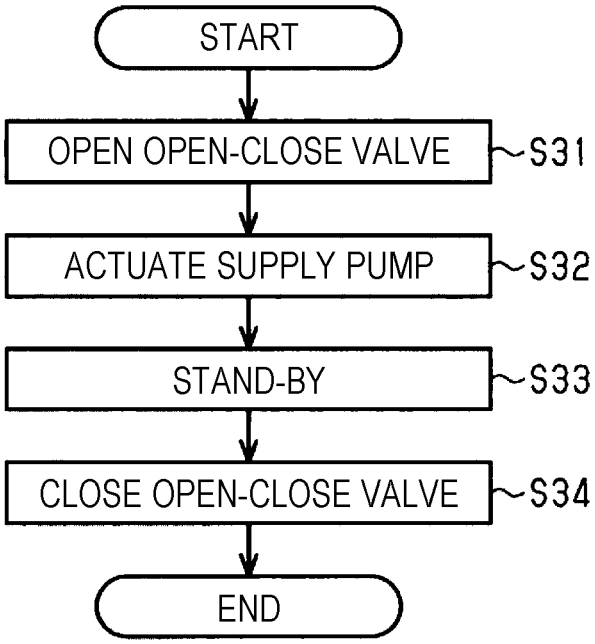
FIG. 7 is a flowchart of a processing routine for an air bubble discharging operation.

As shown in FIG. 7, in Step S31, the control unit 61 that performs the air bubble discharging operation opens the open-close valve 66. Accordingly, the buffer chamber 64 of the buffer 63 is open to the outside via the air bubble discharge flow path 65. That is, the inside of the buffer 63 is open to the atmosphere.

In Step S32, the control unit 61 actuates the supply pump 16. If the supply pump 16 has been already actuated in Step S32, the control unit 61 continues actuation of the supply pump 16.

In Step S33, the control unit 61 stands-by. When the open-close valve 66 remains open while the supply pump 16 is actuated, liquid is supplied to the buffer 63. When the open-close valve 66 remains open while the supply pump 16 is actuated, liquid is stored in the buffer 63, and the amount of stored liquid increases.

As the buffer 63 stores liquid, air bubbles are separated from the liquid. The separated air bubbles are discharged to the outside via the air bubble discharge flow path 65. That is, in Steps S31, S32, and Step S33, the control unit 61 discharges air bubbles contained in the supply flow path 14 via the air bubble discharge flow path 65 by actuating the supply pump 16 while the open-close valve 66 is open. Here, air bubbles may also be discharged together with liquid via the air bubble discharge flow path 65.

In Step S34, the control unit 61 closes the open-close valve 66. When the open-close valve 66 is closed, the air bubble discharging operation is completed. According to this air bubble discharging operation, air bubbles can be discharged without flowing via the nozzles 23. This reduces possibility of air bubbles being left in the liquid ejecting head 12. According to this air bubble discharging operation, air bubbles in the supply flow path 14 can be discharged without discharging liquid. This reduces liquid consumption.

According to the liquid ejecting apparatus 11 of the second embodiment, the following effects can be obtained in addition to the effects described in the above (1), (2) and (3).

(5) According to the air bubble discharging method for discharging air bubbles contained in the supply flow path 14 from the air bubble discharge flow path 65 by actuating supply pump 16 while the open-close valve 66 is open, air bubbles can be effectively discharged. This method reduces possibility of air bubbles being left in the liquid ejecting head 12 since air bubble are not discharged from the nozzles 23.

Third Embodiment

Next, a third embodiment of the liquid ejecting apparatus 11 will now be described. The liquid ejecting apparatus 11 of the third embodiment has the same configuration as that of the liquid ejecting apparatus 11 of the first embodiment except for having a second circulation flow path. Therefore, in the third embodiment, differences in configuration will be mainly described.

Figure 8:
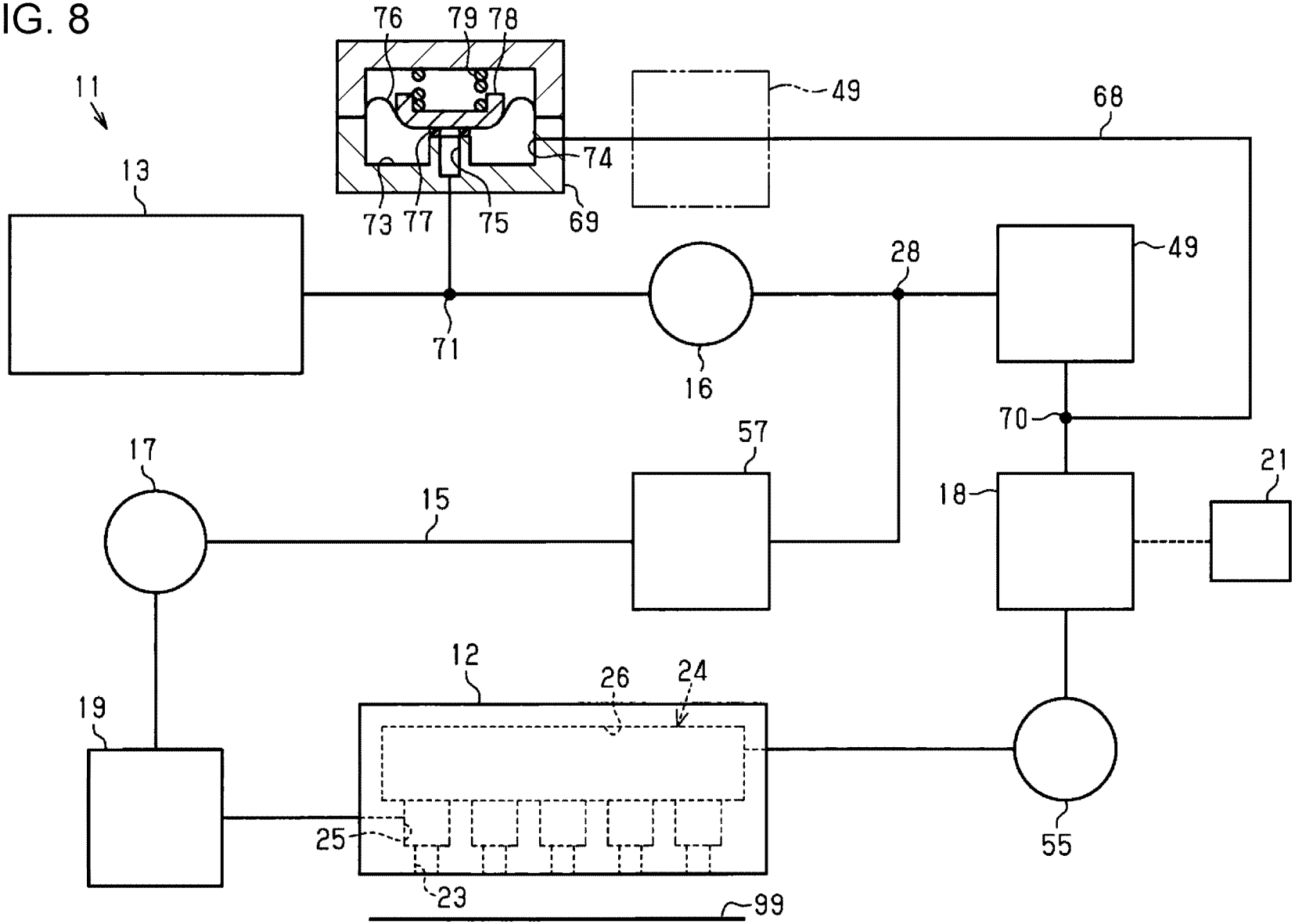
FIG. 8 is an overall configuration diagram of a third embodiment of the liquid ejecting apparatus.

As shown in FIG. 8, the liquid ejecting apparatus 11 of the third embodiment includes a second circulation flow path 68 for circulating liquid, and a third pressure regulating valve 69 that adjusts pressure in the second circulation flow path 68. A first end of the second circulation flow path 68 is connected to a second connecting section 70, which is provided downstream relative to the supply pump 16 in the supply flow path 14. A second end of the second circulation flow path 68 is connected to a third connecting section 71, which is provided upstream relative to the supply pump 16 in the supply flow path 14. In the second circulation flow path 68, an end connected to the second connecting section 70 is an upstream end, and an end connected to the third connecting section 71 is a downstream end. The second connecting section 70 and the third connecting section 71 are connection points between the supply flow path 14 and the second circulation flow path 68.

The third pressure regulating valve 69 opens and closes the second circulation flow path 68. The third pressure regulating valve 69 is provided in the second circulation flow path 68, and opens when the pressure in the second connecting section 70 becomes higher than a predetermined pressure. The third pressure regulating valve 69 has a circulation chamber 73 disposed in the middle of the second circulation flow path 68. The circulation chamber 73 is provided with an inlet port 74 through which liquid flows in and an outlet port 75 through which liquid flows out. The circulation chamber 73 has a wall which is partially formed of a flexible film 76 that can be flexibly displaced. The third pressure regulating valve 69 includes a valve body 77 configured to open and close the outlet port 75, a pressure receiving member 78 that is in contact with the flexible film 76 from outside the circulation chamber 73, and a pressing member 79 that presses the pressure receiving member 78 against the flexible film 76.

The valve body 77 is made of, for example, an elastic material such as rubber, and mounted on the flexible film 76. The valve body 77 is mounted on the surface of the flexible film 76 which faces the circulation chamber 73. The pressure receiving member 78 is in contact with the surface of the flexible film 76 which faces away from the circulation chamber 73.

The pressing member 79 is formed of a spring, for example. The pressing member 79 presses the flexible film 76 via the pressure receiving member 78 in the direction that decreases the volume of the circulation chamber 73. As the flexible film 76 is pressed against the pressing member 79, the valve body 77 is pressed against the wall of the circulation chamber 73 in which the outlet port 75 is open. Accordingly, the valve body 77 closes the outlet port 75. That is, the pressing member 79 presses the pressure receiving member 78 against the flexible film 76 so that the valve body 77 closes the outlet port 75.

When the supply pump 16 is actuated, liquid in the supply flow path 14 is pressurized. The first pressure regulating valve 18 does not open until the pressure in the liquid chamber 24 in the liquid ejecting head 12 becomes lower than a predetermined pressure. Therefore, when the supply pump 16 is actuated, there may be a case where the pressure upstream from the first pressure regulating valve 18 in the supply flow path 14 increases. In this case, the pressure at the second connecting section 70 increases.

As the pressure in the circulation chamber 73 increases due to increase in pressure at the second connecting section 70, the flexible film 76 is flexibly displaced in the direction that increases the volume of the circulation chamber 73. When the pressure applied to an inner surface of the flexible film 76 which faces the circulation chamber 73 becomes higher than the pressure applied to the outer surface of the flexible film 76 which faces away from the circulation chamber 73 and when a difference between the pressure applied to the inner surface and the pressure applied to an outer surface becomes a predetermine amount or more, the flexible film 76 is displaced. Here, the valve body 77 is separated from the wall of the circulation chamber 73 in which the outlet port 75 is formed. Accordingly, the valve body 77 opens the outlet port 75.

When the outlet port 75 is open, liquid flows from the second connecting section 70 toward the third connecting section 71 in the second circulation flow path 68. Liquid flowing in the second circulation flow path 68 is fed back to the supply flow path 14 via the third connecting section 71. Liquid which has returned to the supply flow path 14 is fed downstream by the supply pump 16. That is, liquid is circulated between the supply flow path 14 and the second circulation flow path 68. Accordingly, the pressure in the supply flow path 14 is prevented from excessively increasing.

As an increase in the pressure in the supply flow path 14 is released, the flexible film 76 is displaced to cause the valve body 77 to close the outlet port 75. Thus, the valve body 77 autonomously opens and closes the outlet port 75 in response to a pressure difference between the pressure outside the circulation chamber 73 and the pressure inside the circulation chamber 73.

The third pressure regulating valve 69 is preferably configured such that the outlet port 75 is located at an uppermost position in the circulation chamber 73. This facilitates discharge of a foreign substance such as air bubble which has flowed into the third pressure regulating valve 69.

In the liquid ejecting apparatus 11 having the second circulation flow path 68, the buffer 49 is preferably provided between the supply pump 16 and the second connecting section 70 in the supply flow path 14 or between the second connecting section 70 and the third pressure regulating valve 69 in the second circulation flow path 68. In the third embodiment, the buffer 49 is provided between the supply pump 16 and the second connecting section 70 in the supply flow path 14. As shown by the dot-dot-dashed line in FIG. 8, the buffer 49 may also be provided between the second connecting section 70 and the third pressure regulating valve 69 in the second circulation flow path 68. When the buffer 49 is provided at such a position, liquid circulating in the supply flow path 14 and the second circulation flow path 68 passes through the buffer 49. Accordingly, air bubbles in liquid can be readily collected in the buffer 49.

In the supply flow path 14, the first connecting section 28 is preferably provided upstream relative to the second connecting section 70. In this case, the buffer 49 is further preferably provided between the first connecting section 28 and the second connecting section 70 in the supply flow path 14. When the buffer 49 is provided at such a position, liquid circulating in the supply flow path 14 and the first circulation flow path 15, in addition to the liquid circulating in the supply flow path 14 and the second circulation flow path 68, passes through the buffer 49. Accordingly, air bubbles in liquid can be readily collected in the buffer 49.

Figure 9:
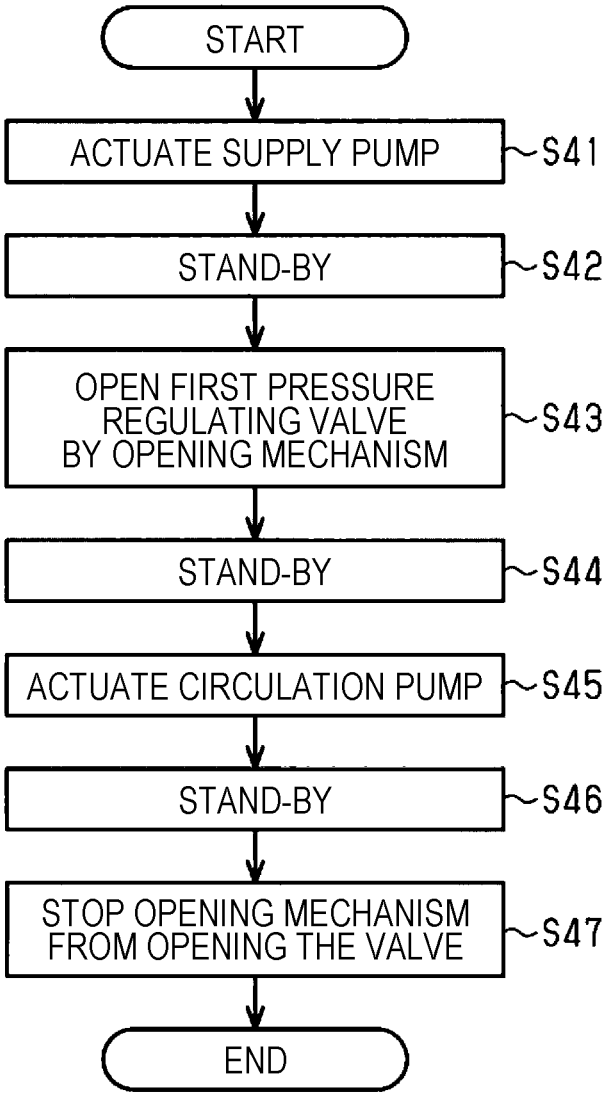
FIG. 9 is a flowchart of a processing routine for a liquid filling operation.

Next, a liquid filling operation performed by the liquid ejecting apparatus 11 of the third embodiment will now be described. As shown in FIG. 9, in Step S41, the control unit 61 that performs the liquid filling operation actuates the supply pump 16. Upon actuation of the supply pump 16, liquid flows from the liquid supply source 13 toward the supply flow path 14. Here, the first pressure regulating valve 18 is closed since the pressure in the liquid ejecting head 12 is equal to an atmospheric pressure.

In Step S42, the control unit 61 stands-by. When the supply pump 16 is continuously actuated, liquid flows from the supply flow path 14 toward the second circulation flow path 68. When the pressure of the supply flow path 14 increases, the third pressure regulating valve 69 opens. Accordingly, the second circulation flow path 68 is filled with liquid. Therefore, in Step S42, the control unit 61 stands-by, for example, for a period of time expected to allow the second circulation flow path 68 to be filled with liquid. In summary, in Steps S41 and S42, the control unit 61 performs a pre-filling step for filling liquid into the second circulation flow path 68 by actuating the supply pump 16.

In Step S43, the control unit 61 opens the first pressure regulating valve 18 by the opening mechanism 21. When the first pressure regulating valve 18 opens while the supply pump 16 is actuated, liquid is supplied from the liquid supply source 13 to the liquid ejecting head 12.

In Step S44, the control unit 61 stands-by. When the first pressure regulating valve 18 remains opened while the supply pump 16 is actuated, the supply flow path 14 and the liquid ejecting head 12 are filled with liquid. In Step S44, the control unit 61 stands-by until the nozzles 23 are filled with liquid. In Step S44, the control unit 61 stands-by, for example, for a period of time expected to allow the nozzles 23 to be filled with liquid. In summary, in Steps S43 and S44, the control unit 61 performs a first filling step for filling liquid into the nozzles 23 by forcibly opening the first pressure regulating valve 18 by using the opening mechanism 21 while the supply pump 16 is actuated.

In Step S45, the control unit 61 actuates the circulation pump 17. In Step S45, the second pressure regulating valve 19 opens since the liquid ejecting head 12 is filled with liquid. When the circulation pump 17 is actuated while the second pressure regulating valve 19 is open, liquid flows from the liquid ejecting head 12 toward the first connecting section 28.

In Step S46, the control unit 61 stands-by. When the circulation pump 17 is continuously actuated, the first circulation flow path 15 is filled with liquid. That is, in Steps S45 and S46, the control unit 61 performs a second filling step for filling liquid into the first circulation flow path 15 by actuating the circulation pump 17 while the supply pump 16 is actuated.

In Step S47, the control unit 61 stops the opening mechanism 21 from opening the valve. When the control unit 61 stops the forcible opening of the first pressure regulating valve 18 by the opening mechanism 21, the liquid filling operation is completed. After completion of the liquid filling operation, the supply pump 16 and the circulation pump 17 remain actuated to thereby circulate liquid. Thus, in the liquid ejecting apparatus 11 of the third embodiment, liquid is filled by the liquid filling method which includes the pre-filling step, the first filling step, and the second filling step. The processing in Step S47 may also be performed between Step S44 and Step S45. That is, forcible opening of the first pressure regulating valve 18 by the opening mechanism 21 may also be stopped between the first filling step and the second filling step.

Next, an air bubble discharging operation performed by the liquid ejecting apparatus 11 of the third embodiment will now be described. The air bubble discharging operation in the third embodiment is the same as that of the first embodiment. As shown in FIG. 4, in Steps S21, S22, and S23, the control unit 61 discharges air bubbles contained in the supply flow path 14 by forcibly opening the first pressure regulating valve 18 by using the opening mechanism 21 while the supply pump 16 is actuated. In particular, in the third embodiment, air bubbles are collected in the buffer 49. Accordingly, in the third embodiment, when the first pressure regulating valve 18 is forcibly opened by the opening mechanism 21 while the supply pump 16 is actuated, air bubbles in the buffer 49 allows to flow together with liquid and are discharged from the nozzles 23. That is, the control unit 61 performs an air bubble discharging step for discharging air bubbles contained in the buffer 49 from the nozzles 23 by forcibly opening the first pressure regulating valve 18 by using the opening mechanism 21 while the supply pump 16 is actuated.

According to the liquid ejecting apparatus 11 of the third embodiment, the following effects can be obtained in addition to the effects described in the above (1) and (2).

(6) The liquid ejecting apparatus 11 includes the second circulation flow path 68 and the third pressure regulating valve 69. When liquid is supplied from the liquid supply source 13 by the supply pump 16 and thus the pressure upstream from the first pressure regulating valve 18 in the supply flow path 14 increases, the third pressure regulating valve 69 opens. When the third pressure regulating valve 69 opens, liquid upstream from the first pressure regulating valve 18 in the supply flow path 14 flows in the second circulation flow path 68. Accordingly, the pressure in the supply flow path 14 is prevented from excessively increasing.

(7) The liquid ejecting apparatus 11 includes the buffer 49 configured to store liquid at a position between the supply pump 16 and the second connecting section 70 in the supply flow path 14 or between the second connecting section 70 and the third pressure regulating valve 69 in the second circulation flow path 68. Accordingly, liquid flowing in the second circulation flow path 68 is supplied to the buffer 49. As liquid is stored in the buffer 49, air bubbles in the liquid can be collected in the buffer 49.

(8) The first connecting section 28 is provided upstream relative to the second connecting section 70 in the supply flow path 14, and the buffer 49 is provided between the first connecting section 28 and the second connecting section 70 in the supply flow path 14. Accordingly, liquid flowing in the first circulation flow path 15 and the second circulation flow path 68 is supplied to the buffer 49. As liquid is stored in the buffer 49, air bubbles in the liquid can be collected in the buffer.

(9) According to the liquid filling method which includes the pre-filling step filling liquid into the second circulation flow path 68 by actuating the supply pump 16, the first filling step for filling liquid into the nozzles 23 by forcibly opening the first pressure regulating valve 18 while the supply pump 16 is actuated, and the second filling step for filling liquid into the first circulation flow path 15 by actuating the circulation pump 17 while the supply pump 16 is actuated, filling of liquid can be effectively performed.

(10) According to the air bubble discharging method which includes the air bubble discharge step of discharging air bubbles contained in the buffer 49 from the nozzles 23 by forcibly opening the first pressure regulating valve 18 by using the opening mechanism 21 while the supply pump 16 is actuated, air bubbles can be effectively discharged.

Fourth Embodiment

Next, a fourth embodiment of the liquid ejecting apparatus 11 will now be described. The liquid ejecting apparatus 11 of the fourth embodiment has the same configuration as that of the liquid ejecting apparatus 11 of the third embodiment except for having the buffer 63 instead of the buffer 49 and the defoaming portion 57. That is, the liquid ejecting apparatus 11 of the fourth embodiment has a configuration achieved by combining a configuration of the liquid ejecting apparatus 11 of the second embodiment and a configuration of the liquid ejecting apparatus 11 of the third embodiment.

Figure 10:
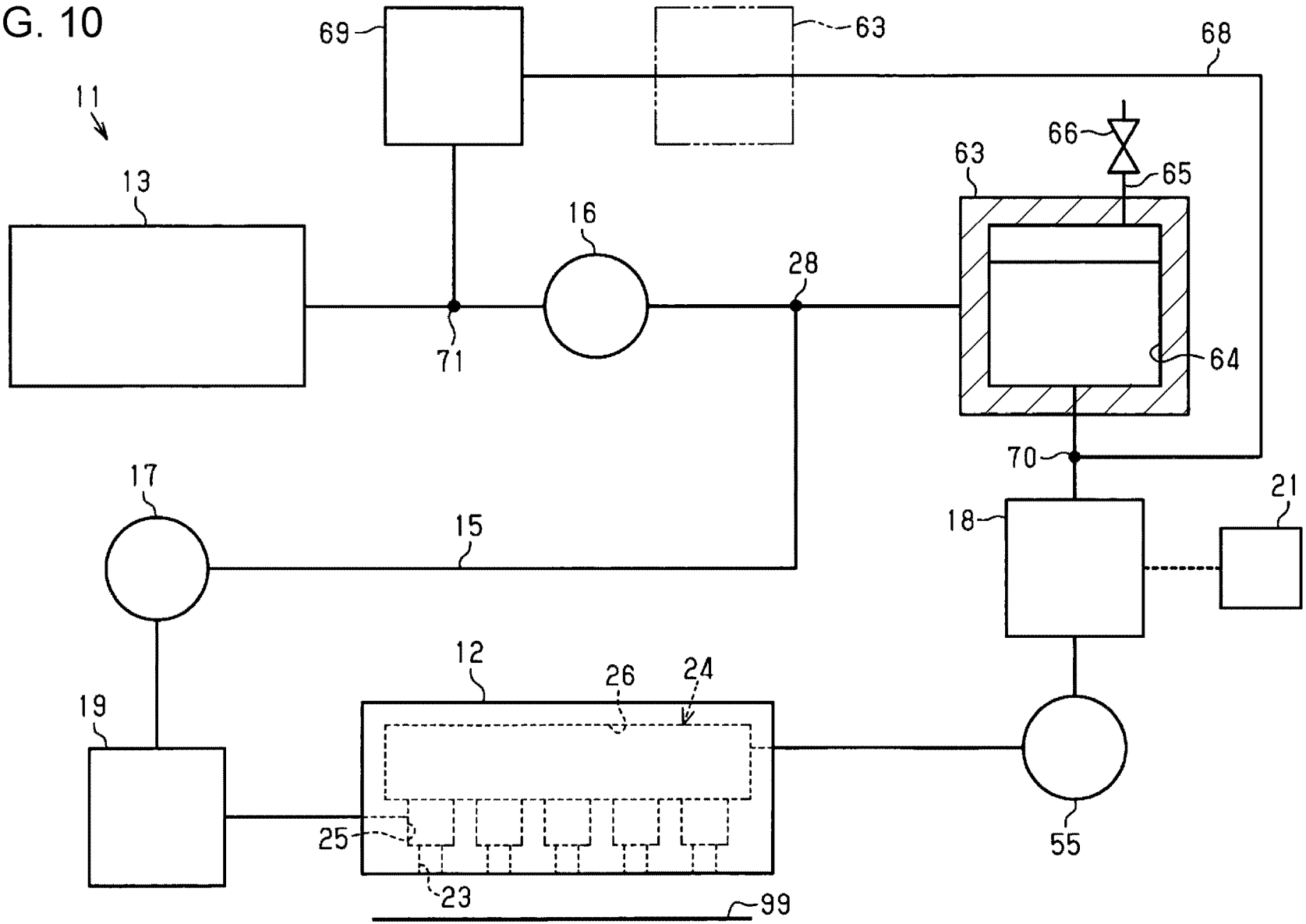
FIG. 10 is an overall configuration diagram of a fourth embodiment of the liquid ejecting apparatus.

As shown in FIG. 10, the liquid ejecting apparatus 11 of the fourth embodiment includes the buffer 63, the air bubble discharge flow path 65, the open-close valve 66, a second circulation flow path 68, and the third pressure regulating valve 69. In the liquid ejecting apparatus 11 having the second circulation flow path 68, the buffer 63 is preferably provided between the supply pump 16 and the second connecting section 70 in the supply flow path 14 or between the second connecting section 70 and the third pressure regulating valve 69 in the second circulation flow path 68.

In the fourth embodiment, the buffer 63 is provided between the supply pump 16 and the second connecting section 70 in the supply flow path 14. As shown by the dot-dot-dashed line in FIG. 10, the buffer 63 may also be provided between the second connecting section 70 and the third pressure regulating valve 69 in the second circulation flow path 68. When the buffer 63 is provided at such a position, liquid circulating in the supply flow path 14 and the second circulation flow path 68 passes through the buffer 63. Accordingly, air bubbles in liquid can be readily collected in the buffer 63.

The first connecting section 28 is provided upstream relative to the second connecting section 70. The buffer 63 is further preferably provided between the first connecting section 28 and the second connecting section 70 in the supply flow path 14. When the buffer 63 is provided at such a position, liquid circulating in the supply flow path 14 and the first circulation flow path 15, in addition to the liquid circulating in the supply flow path 14 and the second circulation flow path 68, passes through the buffer 63. Accordingly, air bubbles in liquid can be readily collected in the buffer 63. The air bubble discharge flow path 65 communicates with the buffer chamber 64 in the buffer 63. The open-close valve 66 is configured to open and close the air bubble discharge flow path 65. The second circulation flow path 68 and the third pressure regulating valve 69 have the same configuration as that of the third embodiment.

Next, a liquid filling operation and air bubble discharging operation performed by the liquid ejecting apparatus 11 of the fourth embodiment will now be described. The liquid filling operation performed by the liquid ejecting apparatus 11 of the fourth embodiment is the same as that of the third embodiment. The air bubble discharging operation performed by the liquid ejecting apparatus 11 of the fourth embodiment is the same as that of the second embodiment.

As shown in FIG. 7, in Steps S31, S32, and Step S33, the control unit 61 discharges air bubbles contained in the supply flow path 14 via the air bubble discharge flow path 65 by actuating the supply pump 16 while the open-close valve 66 is open. Here, air bubbles may also be discharged together with liquid via the air bubble discharge flow path 65. In particular, in the fourth embodiment, air bubbles are collected in the buffer 63. Accordingly, in the fourth embodiment, when the supply pump 16 is actuated while the open-close valve 66 is open, air bubbles in the buffer 63 are discharged from the air bubble discharge flow path 65. That is, the control unit 61 performs an air bubble discharging step for discharging air bubbles contained in the buffer 63 from the air bubble discharge flow path 65 by actuating the supply pump 16 while the open-close valve 66 is open.

According to the liquid ejecting apparatus 11 of the fourth embodiment, the following effects can be obtained in addition to the effects described in the above (1), (2), (6), (7), (8), and (9).

(11) According to the air bubble discharging method which includes the air bubble discharging step for discharging air bubbles contained in the buffer 63 from the air bubble discharge flow path 65 by actuating supply pump 16 while the open-close valve 66 is open, air bubbles can be effectively discharged.

The first to fourth embodiments can be modified and implemented as follows. The embodiments and the following modifications can be implemented in combination with each other within the scope they do not technically conflict.

Figure 11:
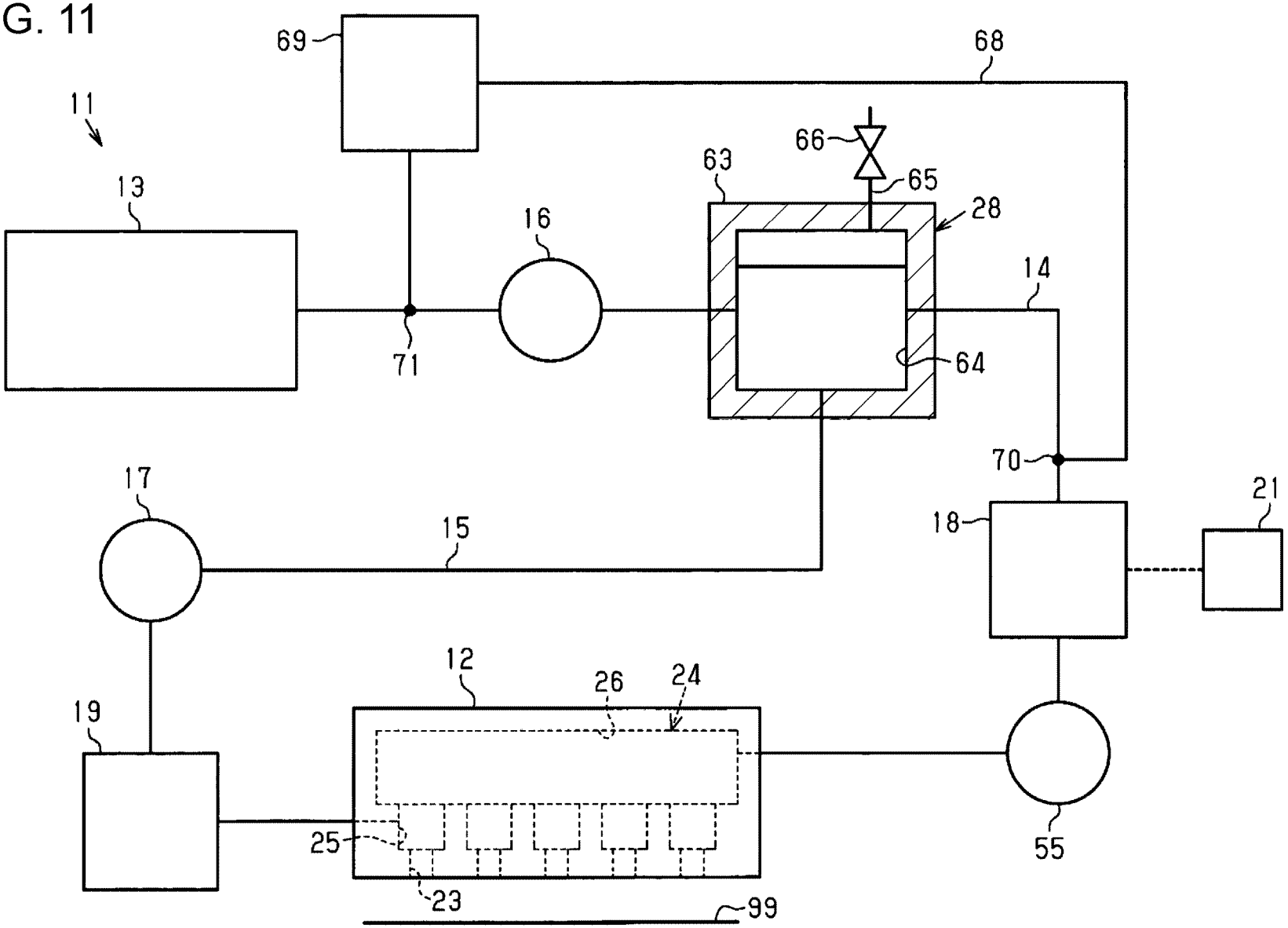
FIG. 11 is an overall configuration diagram of a modification of the liquid ejecting apparatus.

As shown in FIG. 11, in the liquid ejecting apparatus 11 of the fourth embodiment, the buffer 63 is preferably provided between the supply pump 16 and the second connecting section 70 in the supply flow path 14. The first connecting section 28 is more preferably provided in the buffer 63.

According to the above modification, the following effects can be obtained.

(12) Liquid flowing in the first circulation flow path 15 and the second circulation flow path 68 is supplied to the buffer 63. As liquid is stored in the buffer 63, air bubbles in the liquid can be collected in the buffer 63.

Figure 12:
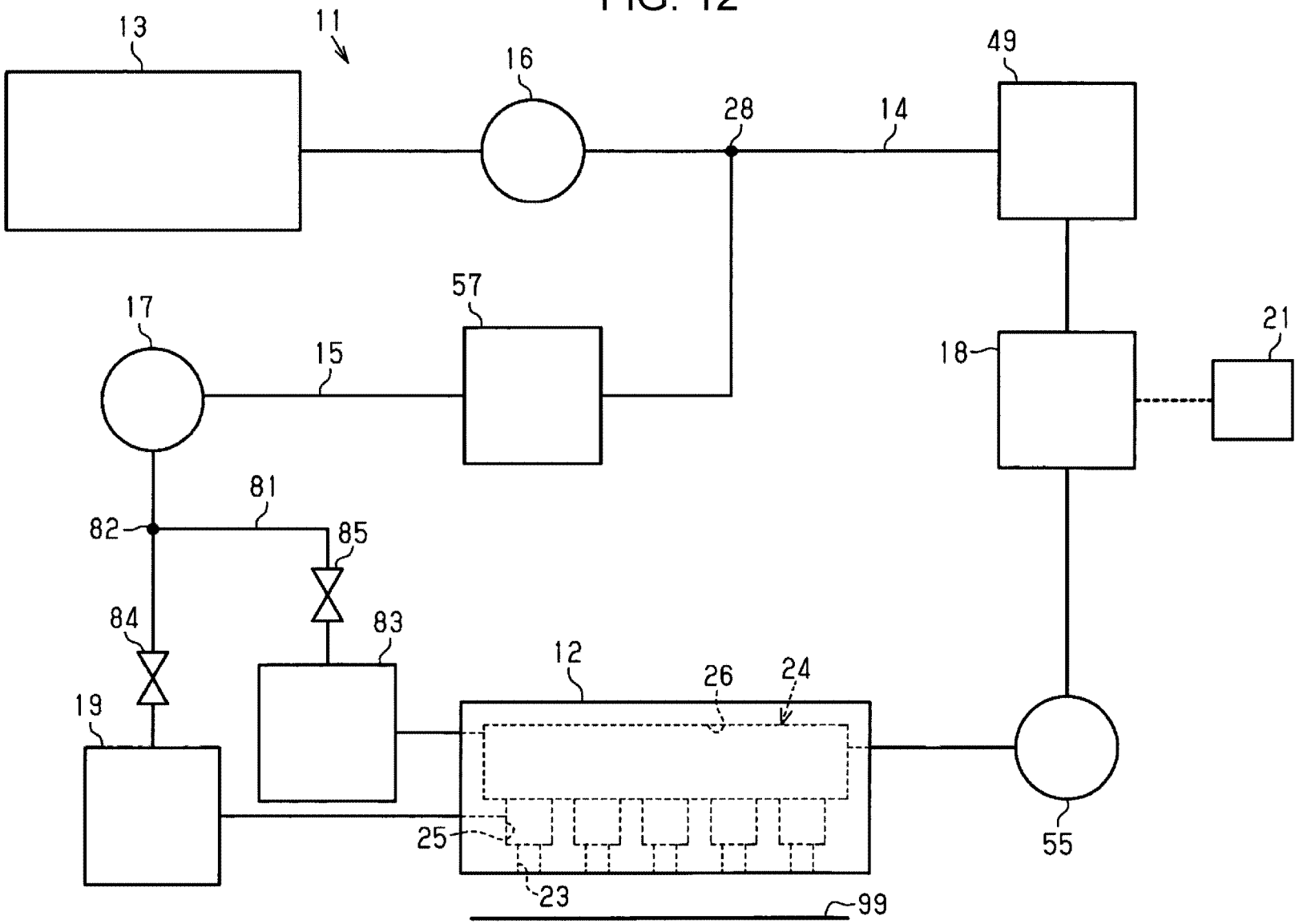
FIG. 12 is an overall configuration diagram of another modification of the liquid ejecting apparatus.

As shown in FIG. 12, the liquid ejecting apparatus 11 of the first embodiment may include a third circulation flow path 81 connected to the liquid chamber 24 of the liquid ejecting head 12, besides the first circulation flow path 15. A first end of the third circulation flow path 81 is connected to the common liquid chamber 26 of the liquid chamber 24. A second end of the third circulation flow path 81 is connected to a fourth connecting section 82 which is provided in the middle of the first circulation flow path 15. The fourth connecting section 82 is located between the second pressure regulating valve 19 and the circulation pump 17 in the first circulation flow path 15. The fourth connecting section 82 is a connection point between the first circulation flow path 15 and the third circulation flow path 81.

In the third circulation flow path 81, a fourth pressure regulating valve 83 having the same configuration as that of the second pressure regulating valve 19 is provided. That is, the fourth pressure regulating valve 83 closes when the pressure of the liquid ejecting head 12 becomes lower than a predetermined pressure. In the first circulation flow path 15, an open-close valve 84 is provided between the second pressure regulating valve 19 and the fourth connecting section 82. In the third circulation flow path 81, an open-close valve 85 is provided between the fourth connecting section 82 and the fourth pressure regulating valve 83.

In this modification, the open-close valve 84 and the open-close valve 85 can be controlled to select whether to circulate liquid from the pressure chamber 25 or from the common liquid chamber 26. For example, by closing the open-close valve 84 and opening the open-close valve 85, liquid can flow from the common liquid chamber 26 to the first circulation flow path 15 via the third circulation flow path 81. In this case, foreign substances such as air bubbles left in the common liquid chamber 26 can be easily discharged.

In this modification, the circulation pump 17 may also be located between the fourth connecting section 82 and the second pressure regulating valve 19 in the first circulation flow path 15. In this case, another circulation pump is preferably provided between the fourth connecting section 82 and the fourth pressure regulating valve 83 in the third circulation flow path 81. Further, this modification can also be applied to the liquid ejecting apparatus 11 in the second to fourth embodiments.

The liquid ejecting apparatus 11 in the first to fourth embodiments may also include an open-close valve at a position in the middle of the supply flow path 14. For example, when the power to the liquid ejecting apparatus 11 is turned off, the open-close valve can be closed to thereby reduce leakage of liquid from the nozzles 23.

The liquid ejecting apparatus 11 in the second and fourth embodiments may also include the defoaming portion 57.

Liquid ejected by the liquid ejecting head 12 in the first to fourth embodiments is not limited to ink, and may be, for example, a liquid material in which particles of a function material are dispersed or mixed in liquid. For example, the liquid ejecting head 12 may eject a liquid material which contains dispersed or dissolved material such as electrode material or color material (pixel material) for use in manufacture of liquid crystal displays, EL (electroluminescence) displays, and surface emitting displays.

The following describes technical ideas and their effects and advantages obtained from the above embodiments and modifications.

Idea 1

A liquid ejecting apparatus including: a liquid ejecting head including a liquid chamber which communicates with a nozzle through which liquid is ejected onto a medium; a supply flow path having a first end connected to a liquid supply source and a second end connected to the liquid chamber; a first circulation flow path having a first end located upstream and a second end located downstream, the first end being connected to the liquid chamber and the second end being connected to a first connecting section which is provided in a middle of the supply flow path; a supply pump provided upstream relative to the first connecting section in the supply flow path, the supply pump being configured to supply the liquid from the liquid supply source in a downstream direction; a first pressure regulating valve provided between the first connecting section and the liquid ejecting head in the supply flow path, the first pressure regulating valve being configured to open when a downstream pressure becomes lower than a predetermined pressure; a second pressure regulating valve provided in the first circulation flow path, the second pressure regulating valve being configured to close when an upstream pressure becomes lower than a predetermined pressure; a circulation pump provided downstream relative to the second pressure regulating valve in the first circulation flow path, the circulation pump being configured to circulate the liquid in a downstream direction; and an opening mechanism configured to forcibly open the first pressure regulating valve.

In filling liquid into the liquid ejecting head and the respective supply flow paths, which are not filled with liquid, actuation of the supply pump is not sufficient to open the first pressure regulating valve since the liquid chamber of the liquid ejecting head is filled with air. According to the above configuration, by forcibly opening the first pressure regulating valve by using the opening mechanism, liquid is supplied from the liquid supply source to the liquid ejecting head via the supply flow path. When liquid is supplied to the liquid ejecting head, liquid is supplied to the first circulation flow path by actuation of the circulation pump. Accordingly, filling of liquid can be easily performed.

Idea 2

The liquid ejecting apparatus according to Idea 1, wherein a circulation flow rate flowing from the liquid chamber to the first circulation flow path in a non-ejection period during which the liquid is not ejected from the nozzle is one-tenth or more of a maximum ejection flow rate of the liquid ejected from the nozzle onto the medium.

Since liquid flows from the liquid chamber to the first circulation flow path, thickening of liquid in the liquid ejecting head can be reduced. According to this configuration, a sufficient amount of liquid can be ensured to flow from the liquid chamber to the first circulation flow path during printing in which liquid is ejected from the nozzles. Accordingly, thickening of liquid in the liquid ejecting head can be reduced.

Idea 3

The liquid ejecting apparatus according to Idea 1 or 2, further including: a second circulation flow path having a first end connected to a second connecting section, which is provided downstream relative to the supply pump in the supply flow path, and a second end connected to a third connecting section, which is provided upstream relative to the supply pump in the supply flow path; and a third pressure regulating valve provided in the second circulation flow path, the third pressure regulating valve being configured to open when a pressure in the second connecting section becomes higher than a predetermined pressure.

According to this configuration, when liquid is supplied from the liquid supply source to the supply flow path by the supply pump and thus the pressure in the second connecting section increases, the third pressure regulating valve opens. When the third pressure regulating valve opens, liquid is circulated between the supply flow path and the second circulation flow path. Accordingly, the pressure in the supply flow path is prevented from excessively increasing.

Idea 4

The liquid ejecting apparatus according to Idea 3, further including a buffer provided between the supply pump and the second connecting section in the supply flow path or between the second connecting section and the third pressure regulating valve in the second circulation flow path, the buffer being configured to store the liquid.

According to this configuration, liquid flowing in the second circulation flow path is supplied to the buffer. As liquid is stored in the buffer, air bubbles in the liquid can be collected in the buffer.

Idea 5

The liquid ejecting apparatus according to Idea 4, wherein the first connecting section is provided upstream relative to the second connecting section in the supply flow path, and the buffer is provided between the first connecting section and the second connecting section in the supply flow path.

According to this configuration, liquid flowing in the first circulation flow path and the second circulation flow path is supplied to the buffer. As liquid is stored in the buffer, air bubbles in the liquid can be collected in the buffer.

Idea 6

The liquid ejecting apparatus according to Idea 4, wherein the buffer is provided between the supply pump and the second connecting section in the supply flow path, and the first connecting section is provided in the buffer.

According to this configuration, liquid flowing in the first circulation flow path and the second circulation flow path is supplied to the buffer. As liquid is stored in the buffer, air bubbles in the liquid can be collected in the buffer.

Idea 7

A liquid filling method for the liquid ejecting apparatus according to Idea 1 or Idea 2, the method including: forcibly opening the first pressure regulating valve by using the opening mechanism while the supply pump is actuated to thereby allow the nozzle to be filled with the liquid; and actuating the circulation pump while the supply pump is actuated to thereby allow the first circulation flow path to be filled with the liquid.

According to this method, filling of liquid can be effectively performed.

Idea 8

An air bubble discharging method for the liquid ejecting apparatus according to Idea 1 or Idea 2, the method including: forcibly opening the first pressure regulating valve by using the opening mechanism while the supply pump is actuated to thereby allow an air bubble in the supply flow path to be discharged from the nozzle.

According to this method, air bubbles can be effectively discharged.

Idea 9

An air bubble discharging method for the liquid ejecting apparatus according to Idea 1 or Idea 2, wherein the liquid ejecting apparatus includes an air bubble discharging flow path connected to the supply flow path at a position downstream relative to the first connecting section, and an open-close valve configured to open and close the air bubble discharging flow path, the method including: actuating the supply pump while the open-close valve is open to thereby allow an air bubble in the supply flow path to be discharged from the air bubble discharge flow path.

According to this method, air bubbles can be effectively discharged.

Idea 10

A liquid filling method for the liquid ejecting apparatus according to any one of Idea 3 to Idea 6, the method including: actuating the supply pump to thereby allow the second circulation flow path to be filled with the liquid; forcibly opening the first pressure regulating valve while the supply pump is actuated to thereby allow the nozzle to be filled with the liquid; and actuating the circulation pump while the supply pump is actuated to thereby allow the first circulation flow path to be filled with the liquid.

According to this method, filling of liquid can be effectively performed.

Idea 11

An air bubble discharging method for the liquid ejecting apparatus according to Idea 5 or Idea 6, the method including: forcibly opening the first pressure regulating valve by using the opening mechanism while the supply pump is actuated to thereby allow an air bubble in the buffer to be discharged from the nozzle.

According to this method, air bubbles can be effectively discharged.

Idea 12

An air bubble discharging method for the liquid ejecting apparatus according to Idea 5 or Idea 6, wherein the liquid ejecting apparatus includes an air bubble discharge flow path which communicates with the buffer, and an open-close valve configured to open and close the air bubble discharge flow path, the method including: actuating the supply pump while the open-close valve is open to thereby allow an air bubble in the buffer to be discharged from the air bubble discharge flow path.

According to this method, air bubbles can be effectively discharged.

What is claimed is:

1. A liquid ejecting apparatus comprising:

a liquid ejecting head including a liquid chamber which communicates with a nozzle through which liquid is ejected onto a medium;

a supply flow path having a first end connected to a liquid supply source and a second end connected to the liquid chamber;

a first circulation flow path having a first end located upstream and a second end located downstream, the first end being connected to the liquid chamber and the second end being connected to a first connecting section which is provided in a middle of the supply flow path;

a supply pump provided upstream relative to the first connecting section in the supply flow path, the supply pump being configured to supply the liquid from the liquid supply source in a downstream direction;

a first pressure regulating valve provided between the first connecting section and the liquid ejecting head in the supply flow path, the first pressure regulating valve being configured to open when a downstream pressure becomes lower than a predetermined pressure;

a second pressure regulating valve provided in the first circulation flow path, the second pressure regulating valve being configured to close when an upstream pressure becomes lower than a predetermined pressure;

a circulation pump provided downstream relative to the second pressure regulating valve in the first circulation flow path, the circulation pump being configured to circulate the liquid in a downstream direction; and an opening mechanism configured to forcibly open the first pressure regulating valve.

2. The liquid ejecting apparatus according to claim 1, wherein a circulation flow rate flowing from the liquid chamber to the first circulation flow path in a non-ejection period during which the liquid is not ejected from the nozzle is one-tenth or more of a maximum ejection flow rate of the liquid ejected from the nozzle onto the medium.

3. The liquid ejecting apparatus according to claim 1, further comprising:

a second circulation flow path having a first end connected to a second connecting section, which is provided downstream relative to the supply pump in the supply flow path, and a second end connected to a third connecting section, which is provided upstream relative to the supply pump in the supply flow path; and a third pressure regulating valve provided in the second circulation flow path, the third pressure regulating valve being configured to open when a pressure in the second connecting section becomes higher than a predetermined pressure.

4. The liquid ejecting apparatus according to claim 3, further comprising:

a buffer provided between the supply pump and the second connecting section in the supply flow path or between the second connecting section and the third pressure regulating valve in the second circulation flow path, the buffer being configured to store the liquid.

5. The liquid ejecting apparatus according to claim 4, wherein the first connecting section is provided upstream relative to the second connecting section in the supply flow path, and the buffer is provided between the first connecting section and the second connecting section in the supply flow path.

6. The liquid ejecting apparatus according to claim 4, wherein the buffer is provided between the supply pump and the second connecting section in the supply flow path, and the first connecting section is provided in the buffer.

7. A liquid filling method for the liquid ejecting apparatus according to claim 1, the method comprising:

forcibly opening the first pressure regulating valve by using the opening mechanism while the supply pump is actuated to thereby allow the nozzle to be filled with the liquid; and actuating the circulation pump while the supply pump is actuated to thereby allow the first circulation flow path to be filled with the liquid.

8. An air bubble discharging method for the liquid ejecting apparatus according to claim 1, the method comprising:

forcibly opening the first pressure regulating valve by using the opening mechanism while the supply pump is actuated to thereby allow an air bubble in the supply flow path to be discharged from the nozzle.

9. An air bubble discharging method for the liquid ejecting apparatus according to claim 1, wherein the liquid ejecting apparatus includes an air bubble discharging flow path connected to the supply flow path at a position downstream relative to the first connecting section, and an open-close valve configured to open and close the air bubble discharging flow path, the method comprising:

actuating the supply pump while the open-close valve is open to thereby allow an air bubble in the supply flow path to be discharged from the air bubble discharge flow path.

10. A liquid filling method for the liquid ejecting apparatus according to claim 3, the method comprising:

actuating the supply pump to thereby allow the second circulation flow path to be filled with the liquid;

forcibly opening the first pressure regulating valve while the supply pump is actuated to thereby allow the nozzle to be filled with the liquid; and actuating the circulation pump while the supply pump is actuated to thereby allow the first circulation flow path to be filled with the liquid.

11. An air bubble discharging method for the liquid ejecting apparatus according to claim 5, the method comprising:

forcibly opening the first pressure regulating valve by using the opening mechanism while the supply pump is actuated to thereby allow an air bubble in the buffer to be discharged from the nozzle.

12. An air bubble discharging method for the liquid ejecting apparatus according to claim 5, wherein the liquid ejecting apparatus includes an air bubble discharge flow path which communicates with the buffer, and an open-close valve configured to open and close the air bubble discharge flow path, the method comprising:

actuating the supply pump while the open-close valve is open to thereby allow an air bubble in the buffer to be discharged from the air bubble discharge flow path.

13. An air bubble discharging method for the liquid ejecting apparatus according to claim 6, wherein the liquid ejecting apparatus includes an air bubble discharge flow path which communicates with the buffer, and an open-close valve configured to open and close the air bubble discharge flow path, the method comprising:

actuating the supply pump while the open-close valve is open to thereby allow an air bubble in the buffer to be discharged from the air bubble discharge flow path.

* * * * *